US012767366B2

(12) United States Patent
Hubschmid et al.

(10) Patent No.: US 12,767,366 B2
(45) Date of Patent: Oct. 20, 2026

(54) STRAPPING DEVICE WITH MOVABLE MOTOR

(71) Applicant: Signode Industrial Group LLC, Tampa, FL (US)

(72) Inventors: Benjamin Hubschmid, Auenstein (CH); Yannick Fischbacher, Fahrweid (CH); Michael Solinger, Höri (CH); Mirco Neeser, Ehrendingen (CH); Andreas Keller, Birr (CH)

(73) Assignee: Signode Industrial Group LLC, Tampa, FL (US)

( * ) Notice: Subject to any disclaimer, the term of this patent is extended or adjusted under 35 U.S.C. 154(b) by 109 days.

(21) Appl. No.: 18/836,565

(22) PCT Filed: Feb. 8, 2023

(86) PCT No.: PCT/US2023/062183

§ 371 (c)(1),
(2) Date: Aug. 7, 2024

(87) PCT Pub. No.: WO2023/158950

PCT Pub. Date: Aug. 24, 2023

(65) Prior Publication Data

US 2025/0136311 A1 May 1, 2025

Related U.S. Application Data

(60) Provisional application No. 63/268,082, filed on Feb. 16, 2022.

(51) Int. Cl.
*B65B 13/18* (2006.01)
*B65B 13/02* (2006.01)

(52) U.S. Cl.
CPC ..... *B65B 13/187* (2013.01); *B65B 13/025* (2013.01)

(58) Field of Classification Search
CPC ..... B65B 13/025; B65B 13/187
See application file for complete search history.

(56) References Cited

U.S. PATENT DOCUMENTS 1,891,239 A 12/1932 Ekern
1,984,652 A 12/1934 Ekern
(Continued)

FOREIGN PATENT DOCUMENTS

BR 112014014798 A2 6/2017
BR 112014015409 A2 6/2017
(Continued)

OTHER PUBLICATIONS

Notification of Reasons for Rejection with English translation, from corresponding Japanese Patent Application No. 2024-548389, Jul. 29, 2025.

(Continued)

*Primary Examiner* — Eyamindae C Jallow
(74) *Attorney, Agent, or Firm* — Neal, Gerber & Eisenberg LLP

(57) ABSTRACT

The present disclosure provides a strapping tool with a motor that is housed within a housing of the strapping tool and that drives a drive gear that is drivingly engaged with a driven gear. The driven gear is operably connected to a tensioning assembly to drive a tension wheel of the tensioning assembly to tension strap sandwiched between the tension wheel and a tension plate on a support of the strapping wheel. The tensioning assembly is pivotably mounted to the support to enable the operator to pivot the tension wheel away from the tension plate to make room for the strap (or remove the strap). The motor is movable relative to the housing and the tensioning assembly such that, as the tensioning assembly pivots relative to the support, the motor moves relative to the housing and the (Continued)

tensioning assembly so the drive gear maintains driving engagement with the driven gear.

20 Claims, 20 Drawing Sheets

(56) References Cited

U.S. PATENT DOCUMENTS 2,007,002 A 7/1935 Porter
2,040,576 A 5/1936 Erich
2,076,276 A 4/1937 Porter
2,257,090 A 9/1941 Childress
2,336,264 A 12/1943 Leslie, II
2,661,030 A 12/1953 Crosby et al.
2,801,558 A 8/1957 Crosby et al.
2,915,003 A 12/1959 Crosby et al.
2,936,156 A 5/1960 Coupland
2,941,782 A 6/1960 Winkler
2,986,376 A 5/1961 Falck-Pedersen
3,028,885 A 4/1962 Leslie et al.
3,032,075 A 5/1962 Hall et al.
3,103,955 A 9/1963 Ericsson et al.
3,150,694 A 9/1964 Meier
3,198,218 A 8/1965 Ericsson et al.
3,206,167 A 9/1965 Armington
3,211,186 A 10/1965 Harold
3,249,131 A 5/1966 Lingle
3,284,049 A 11/1966 Haraden
3,319,666 A 5/1967 Victor et al.
3,360,017 A 12/1967 Vilcins
3,396,760 A 8/1968 Peter et al.
3,442,732 A 5/1969 Stensaker et al.
3,442,733 A 5/1969 Vilcins
3,442,734 A 5/1969 Ericsson
3,506,041 A 4/1970 Angarola
3,583,315 A 6/1971 Hebert
3,586,572 A 6/1971 Ericsson
3,654,033 A 4/1972 Angarola et al.
3,690,350 A 9/1972 Sansum
3,718,526 A 2/1973 Annis
3,769,859 A 11/1973 Sykes et al.
3,792,808 A 2/1974 Neff et al.
3,799,835 A 3/1974 Gilmore
3,810,495 A 5/1974 Pack
3,844,317 A 10/1974 Angarola et al.
3,863,684 A 2/1975 Simmons
4,015,643 A 4/1977 Cheung
4,020,879 A 5/1977 Billett et al.
4,041,787 A 8/1977 Brundler
4,159,725 A 7/1979 Bachmann et al.
4,239,096 A 12/1980 Smilgys et al.
4,245,678 A 1/1981 Sansum
4,282,907 A 8/1981 Massion et al.
4,305,774 A 12/1981 Wedeking et al.
4,313,779 A 2/1982 Nix
4,356,845 A 11/1982 Kimbrough
4,450,032 A 5/1984 Wehr
4,488,926 A 12/1984 Rauch et al.
4,574,848 A 3/1986 Bartzick et al.
4,607,709 A 8/1986 Walser
4,718,522 A 1/1988 Frania et al.
5,078,185 A 1/1992 Angarola
5,632,851 A 5/1997 Young
5,653,095 A 8/1997 Stamm
5,689,943 A 11/1997 Wehr
5,881,855 A 3/1999 Putney et al.
5,916,108 A 6/1999 Drietz et al.
6,003,578 A 12/1999 Chang
6,109,325 A 8/2000 Chang
6,206,053 B1 3/2001 Hillegonds
6,308,760 B1 10/2001 Finzo et al.
6,328,087 B1 12/2001 Finzo et al.
6,332,306 B1 12/2001 Finzo et al.
6,338,375 B1 1/2002 Harada
6,415,712 B1 7/2002 Helland et al.
6,422,272 B1 7/2002 Crittenden
6,578,337 B2 6/2003 Scholl et al.
6,895,733 B2 5/2005 Nix
6,918,235 B2 7/2005 Nix
7,073,431 B1 7/2006 Chen
7,089,970 B2 8/2006 Bernard
7,155,885 B1 1/2007 Nasiatka et al.
7,497,068 B2 3/2009 Nasiatka et al.
7,857,560 B2 12/2010 Leggett et al.
8,387,523 B2 3/2013 Yang
8,522,830 B2 9/2013 Barlasov et al.
8,567,310 B2 10/2013 Yi
9,085,070 B2 7/2015 Skonieczy et al.
9,254,932 B2 2/2016 Neeser et al.
9,272,799 B2 3/2016 Figiel et al.
9,284,080 B2 3/2016 Neeser et al.
9,315,283 B2 4/2016 Neeser et al.
9,346,572 B2 5/2016 Leppert
9,403,609 B2 8/2016 Bonifazi et al.
9,468,968 B2 10/2016 Figiel et al.
9,487,314 B2 11/2016 Finzo
9,586,708 B2 3/2017 Finzo
9,630,265 B2 4/2017 Figiel et al.
9,630,730 B2 4/2017 Leppert
9,932,135 B2 4/2018 Finzo et al.
9,994,341 B2 6/2018 Amacker et al.
10,183,769 B2 1/2019 Figiel et al.
10,308,383 B2 6/2019 Boss et al.
10,322,831 B2 6/2019 Nasiatka et al.
10,464,699 B2 11/2019 Figiel et al.
10,577,137 B2 3/2020 Nasiatka et al.
10,745,158 B2 8/2020 Sikora et al.
10,882,649 B2 1/2021 Rauch
11,053,034 B1 7/2021 Sikora et al.
11,084,610 B2 8/2021 Boss et al.
11,104,460 B2 8/2021 Neeser et al.
11,111,039 B2 9/2021 Yang
11,130,598 B2 9/2021 Sikora et al.
11,155,375 B2 10/2021 Keller et al.
11,174,051 B2 11/2021 Graef et al.
11,247,792 B2 * 2/2022 Mellas ..... B65B 13/025
11,267,596 B2 3/2022 Finzo et al.
11,352,153 B2 6/2022 Keller et al.
11,414,225 B2 8/2022 Brettschneider et al.
11,492,157 B2 * 11/2022 Hochstrasser ..... B65B 13/025
11,560,246 B2 1/2023 Neeser et al.
11,577,866 B2 2/2023 Nasiatka et al.
11,597,547 B2 3/2023 Finzo
11,667,417 B2 6/2023 Finzo et al.
11,999,516 B2 6/2024 Neeser et al.
2002/0179175 A1 12/2002 Finzo
2003/0056337 A1 3/2003 Scholl et al.
2003/0221566 A1 * 12/2003 Apel ..... B65B 13/22 100/29
2003/0230058 A1 12/2003 Nix
2005/0000586 A1 1/2005 Zeimetz et al.
2008/0219745 A1 9/2008 Bungert et al.
2010/0077810 A1 4/2010 De
2011/0056390 A1 * 3/2011 Neeser ..... B65B 13/025 100/29
2011/0056391 A1 3/2011 Neeser et al.
2011/0056392 A1 * 3/2011 Neeser ..... B65B 13/025 100/29
2011/0100233 A1 5/2011 Neeser et al.
2012/0210682 A1 8/2012 Gardner et al.
2014/0083311 A1 * 3/2014 Bonifazi ..... B65B 13/025 100/29
2014/0290179 A1 10/2014 Keller
2015/0033959 A1 2/2015 Finzo
2015/0034206 A1 2/2015 Finzo
2015/0210411 A1 7/2015 Finzo et al.
2015/0246739 A1 9/2015 Finzo et al.
2015/0321777 A1 11/2015 Nasiatka et al.
2016/0107775 A1 * 4/2016 Amacker ..... B65B 13/327 100/29
2016/0376041 A1 12/2016 Skonieczny, Jr. et al.
2017/0008652 A1 * 1/2017 Figiel ..... G05B 19/0426
2017/0166335 A1 6/2017 Nasiatka et al.
2017/0174374 A1 6/2017 Figiel et al.

(56) References Cited

U.S. PATENT DOCUMENTS

| | | | |
|---|---|---|---|
| 2018/0054033 | A1 | 2/2018 | Skonieczny et al. |
| 2018/0127124 | A1 | 5/2018 | Sikora et al. |
| 2019/0256233 | A1 | 8/2019 | Sikora et al. |
| 2020/0339289 | A1 | 10/2020 | Finzo |
| 2020/0339290 | A1 | 10/2020 | Finzo |
| 2020/0377245 | A1 | 12/2020 | Sikora et al. |
| 2021/0371143 | A1 | 12/2021 | Sikora et al. |
| 2022/0119140 | A1 | 4/2022 | Sikora et al. |
| 2022/0144463 | A1 | 5/2022 | Finzo et al. |
| 2023/0088358 | A1 | 3/2023 | Sikora et al. |
| 2023/0150704 | A1 | 5/2023 | Neeser et al. |
| 2023/0150705 | A1 | 5/2023 | Sikora et al. |
| 2024/0174393 | A1 | 5/2024 | Kmiecik et al. |

FOREIGN PATENT DOCUMENTS

| | | | |
|---|---|---|---|
| CN | 2346694 | Y | 11/1999 |
| CN | 1297270 | A | 5/2001 |
| CN | 1386675 | A | 12/2002 |
| CN | 1386676 | A | 12/2002 |
| CN | 1388040 | A | 1/2003 |
| CN | 201102638 | Y | 8/2008 |
| CN | 201411059 | Y | 2/2010 |
| CN | 101391661 | B | 6/2011 |
| CN | 102256875 | A | 11/2011 |
| CN | 105358432 | A | 2/2016 |
| CN | 207547760 | U | 6/2018 |
| CN | 110626539 | A | 12/2019 |
| CN | 110723340 | A | 1/2020 |
| CN | 110482328 | B | 9/2020 |
| CN | 111688974 | A | 9/2020 |
| CN | 212401689 | U | 1/2021 |
| CN | 112619948 | A | 4/2021 |
| DE | 929114 | C | 6/1955 |
| DE | 1185532 | B | 1/1965 |
| DE | 1973947 | U | 11/1967 |
| DE | 3525647 | A1 | 1/1987 |
| DE | 29507452.3 | U1 | 7/1995 |
| DE | 10026200 | A1 | 11/2001 |
| DE | 102009016302 | A1 | 10/2010 |
| DE | 102011122157 | A1 | 6/2013 |
| EP | 0480627 | A1 | 4/1992 |
| EP | 0664256 | A1 | 7/1995 |
| EP | 0703146 | A1 | 3/1996 |
| EP | 0999132 | A1 | 5/2000 |
| EP | 1260441 | A1 | 11/2002 |
| EP | 1371560 | A1 | 12/2003 |
| EP | 1413519 | A1 | 4/2004 |
| EP | 1582463 | A2 | 10/2005 |
| EP | 3272659 | A1 | 1/2018 |
| EP | 3696102 | A1 | 8/2020 |
| EP | 3696103 | A1 | 8/2020 |
| EP | 3730415 | A1 | 10/2020 |
| GB | 896398 | A | 5/1962 |
| GB | 1331225 | A | 9/1973 |
| GB | 2098163 | A | 11/1982 |
| GB | 2185229 | A | 7/1987 |
| GB | 2185228 | B | 12/1987 |
| JP | S36020086 | Y | 8/1961 |
| JP | 01006555 | A | 1/1989 |
| JP | 2004018117 | A | 1/2004 |
| JP | 2009250321 | A | 10/2009 |
| KR | 100943256 | B1 | 2/2010 |
| KR | 20100135275 | A | 12/2010 |
| TW | M258045 | U | 3/2005 |
| WO | 2009129634 | A1 | 10/2009 |
| WO | 2009129636 | A1 | 10/2009 |
| WO | 2019165142 | A1 | 8/2019 |

OTHER PUBLICATIONS desmondttm123,https://forum.arduino.cc/t/convert-a-rotational-motor-to-a-linear-motor/163939 (Year: 2013).

"CB130 Operating Instructions—Hand Tool", Cyklop, available before the priority date of the present application.

"Cyklop CB130 Strapping Tool", available before the priority date of the present application and described in the internal "Service" document that to Applicant's knowledge was not publicly available before the priority date of the present application.

"Description of the Operating Sequence of the Cyklop CB 130 Tool", The Cyklop CB 130 Tool was publicly available before the priority date of the present application.

"Operating Instructions STR 64 Pneumatic Hand Tool For Steel Strapping", Orgapack GmbH, publicly available before the priority date of the present application.

"Operation Manual for Grippack 100/114 Sealers", Signode Industrial Group LLC, available before the priority date of the present application.

"Operation Manual for SLB Sealless Strapping Tool", Signode Industrial Group LLC, available before the priority date of the present application.

"Operation, Parts and Safety Manual PNSC-2 Pneumatic Combination Strapping Tool", Signode, publicly available before the priority date of the present application.

"Operation, Parts and Safety Manual RCNS2-34 RCNS2-114 Pistol-Grip Style Air Powered Sealers", Signode Engineered Products, publicly available before the priority date of the present application.

"OR-T 100 Operating and Safety Instructions", Orgapack, Battery-hand tool for plastic strapping, Nov. 2004.

"OR-T 120 Operating Instructions", Orgapack, Battery-operated hand tool for plastic strapping, Sep. 2012.

"OR-T 130, OR-T 260, OR-T 450 Operating Instructions", Orgapack, Battery-operated hand tool for plastic strapping, Mar. 2017.

"OR-T 200 Manual Battery-hand Tool for Plastic Strapping", Orgapack, available before the priority date of the present application.

"OR-T 250 Manual Battery-operated Hand Tool for Plastic Strapping", Orgapack, available before the priority date of the present application.

"OR-T 300 Operating and Safety Instructions", Orgapack, Battery-hand tool for plastic strapping, Mar. 2005.

"OR-T 400 Operating Instructions", Orgapack, Battery-hand tool for plastic strapping, Sep. 2009.

"OR-T 50 Operating and Safety Instructions", Orgapack, Hand tool for plastic strapping, May 2006.

"ORT 83 Operating Instructions", Orgapack, Hand tool for plastic strapping, Aug. 2000.

"OR-T 85 Operating Instructions", Orgapack, Hand tool for plastic strapping, Jun. 2000.

"OR-T 86 Operating Instructions", Orgapack, Hand tool for plastic strapping, Aug. 1999.

"OR-T 87 Operating and Safety Instructions", Orgapack, Hand tool for plastic strapping, May 2002.

"Service Manual Battery-Powered Plastic Strapping Tool Model P329", Fromm, available before the priority date of the present application.

"CB 130 Hand Tool for PP/PET Strapping Service For Internal Use Only", Cyklop GmbH, Aug. 2002 (indicated at p. 2), 39 pages.

"CB 130 Operating Manual Hand tool for PP/PET—strapping", Cyklop GmbH, Mar. 7, 2002 (indicated at p. 2), 22 pages.

"Friction Weld—Battery Powered—CB 130", Polyester / Polypropylene Friction Weld Single-Handed Operation, Cyklop International, the CB-130 tool was publicly available before the priority date of the present application.

"Fromm Operation Manual / Spare Parts List", Battery—Powered Plastic Strapping Tool Model P331 M/HA, FROMM System GmbH, Mar. 6, 2014 (indicated at p. 1), 26 pages.

"Fromm Operation Manual/Spare Parts List", Battery—Powered Plastic Strapping Tool Model P328 M/HA, Fromm System GmbH, Mar. 6, 2014 (indicated at p. 1), 26 pages.

"Hand Tool CB 130 Operating Instructions", Cyklop GmbH, Mar. 7, 2002 (indicated at p. 2), 26 pages.

"SIAT GT One User's Manual", M. J. Maillis Group, SIAT S.p.a, May 15, 2012 (indicated at p. 99); 102 pages.

"International Search Report and Written Opinion", from corresponding International Patent Application No. PCT/US2023/062183, Sep. 15, 2023.

(56) References Cited

OTHER PUBLICATIONS

First Office Action and Search Report with English Translation, from related Chinese Patent Application No. 202380021916.2, Jun. 9, 2026.
Liu, et al., "Discussion on Design for Small Automatic Rebar Tying Machine", Chongqing Architecture, No. 06, p. 49-51, Jun. 25, 2016.
First Office Action and Search Report with English Translation, from related Republic of Korea Patent Application No. 202380021916.2, Jun. 9, 2026.

* cited by examiner

STRAPPING DEVICE WITH MOVABLE MOTOR

PRIORITY

This application is a national phase application of PCT/US2023/062183, filed on Feb. 8, 2023, which claims priority to and the benefit of U.S. Provisional Patent Application No. 63/268,082, filed Feb. 16, 2022, the entire contents of which is incorporated herein by reference.

FIELD

The present disclosure relates to strapping devices, and more particularly to strapping devices configured to tension strap around a load and to attach overlapping portions of the strap to one another to form a tensioned strap loop around the load.

BACKGROUND

Strapping devices are configured to tension strap around a load and to attach overlapping portions of the strap to one another to form a tensioned strap loop around the load. Battery-powered strapping tools are one type of strapping device. To use one of these strapping tools to form a tensioned strap loop around a load, an operator pulls strap leading end first from a strap supply, wraps the strap around the load, and positions the leading end of the strap below another portion of the strap. The operator then introduces one or more (depending on the type of strapping tool) of these overlapped strap portions into the strapping tool and actuates one or more buttons to initiate: (1) a tensioning cycle during which a tensioning assembly tensions the strap around the load; and (2) after completion of the tensioning cycle, a sealing cycle during which a sealing assembly attaches the overlapped strap portions to one another (thereby forming a tensioned strap loop around the load) and during which a cutting assembly cuts the strap from the strap supply.

How the strapping tool attaches overlapping portions of the strap to one another during the sealing cycle depends on the type of strapping tool and the type of strap. Certain strapping tools configured for plastic strap (such as polypropylene strap or polyester strap) include friction welders, heated blades, or ultrasonic welders configured to attach the overlapping portions of the strap to one another. Some strapping tools configured for plastic strap or metal strap (such as steel strap) include jaws that mechanically deform (referred to as "crimping" in the strapping industry) or cut notches into (referred to as "notching" in the strapping industry) a seal element positioned around the overlapping portions of the strap to attach them to one another. Other strapping tools configured for metal strap include punches and dies configured to form a set of mechanically interlocking cuts in the overlapping portions of the strap to attach them to one another (referred to in the strapping industry as a "sealless" attachment).

Since strapping tool operators can use handheld strapping tools hundreds of times each day, there is a continuing need to make the strapping tools as light as possible (without sacrificing performance) and to balance the weight of the strapping tools to make them easy to use and to reduce operator fatigue.

SUMMARY

Various embodiments of the present disclosure provide a strapping tool with a motor that is housed within a housing of the strapping tool and that drives a drive gear that is drivingly engaged with a driven gear. The driven gear is operably connected to a tensioning assembly to drive a tension wheel of the tensioning assembly to tension strap sandwiched between the tension wheel and a tension plate on a support of the strapping wheel. The tensioning assembly is pivotably mounted to the support to enable the operator to pivot the tension wheel away from the tension plate to make room for the strap (or remove the strap). The motor is movable relative to the housing and the tensioning assembly such that, as the tensioning assembly pivots relative to the support, the motor moves relative to the housing and the tensioning assembly so the drive gear maintains driving engagement with the driven gear.

DETAILED DESCRIPTION

Figure 1A:
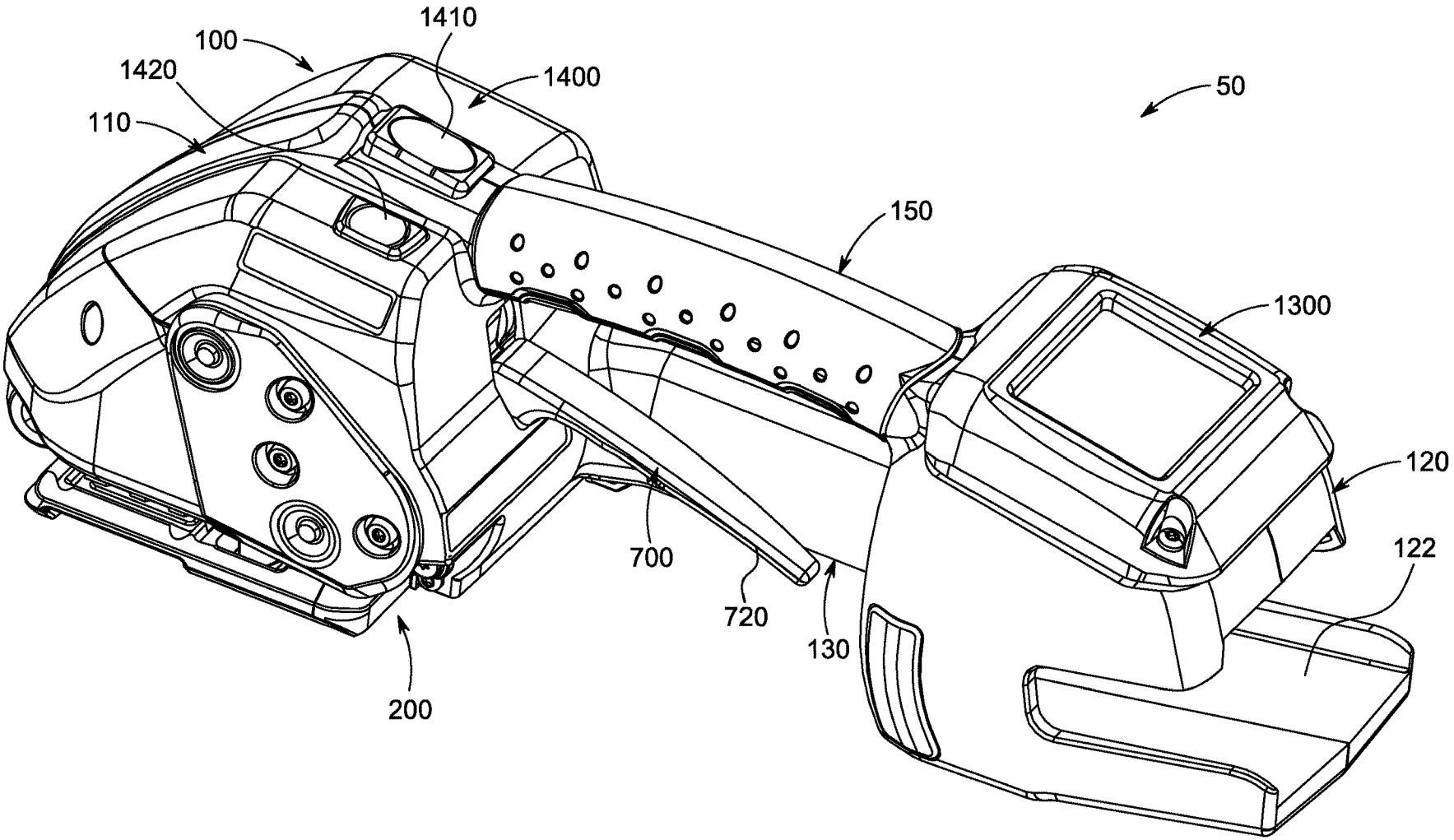
FIGS. 1A and 1B are perspective views of one example embodiment of a strapping tool of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIGS. 1A-9C show one example embodiment of a strapping device of the present disclosure in the form of a strapping tool 50 (sometimes referred to as the "tool" in the Detailed Description for brevity) and certain assemblies and components thereof. As shown in FIGS. 2A-2C, the strapping tool 50 is configured to carry out a strapping cycle to tension and seal strap S (metal strap in this example embodiment) around a load L on a pallet P to form a tensioned strap loop that secures the load L to the pallet P. An operator pulls strap S from a strap supply (not shown) and wraps the strap around the load L and through the openings in the pallet P until a lower portion LP of the strap S (which includes the leading end of the strap S) is positioned below an upper portion UP of the strap S, as shown in FIG. 2A. The operator then introduces the overlapped upper and lower portions UP and LP of the strap S into the strapping tool 50 and actuates one or more buttons to initiate the strapping cycle. As shown in FIG. 2B, a motor drives a tensioning assembly to carry out a tensioning cycle during which the strapping tool 50 tensions strap S around the load L. Once a preset tension is reached in the strap S, as shown in FIG. 2C, the motor drives a sealing assembly to carry out a sealing cycle during which the strapping tool 50 cuts keys K into the upper and lower portions UP and LP of the strap S, as shown in FIG. 2D, and cuts the strap S from the strap supply. Since the strap S is under tension, cutting the strap from the strap supply causes the upper portion UP to slide relative to the lower portion LP to mechanically interlock the keys K to form a sealless strap joint J, as shown in FIG. 2D.

Figure 1B:
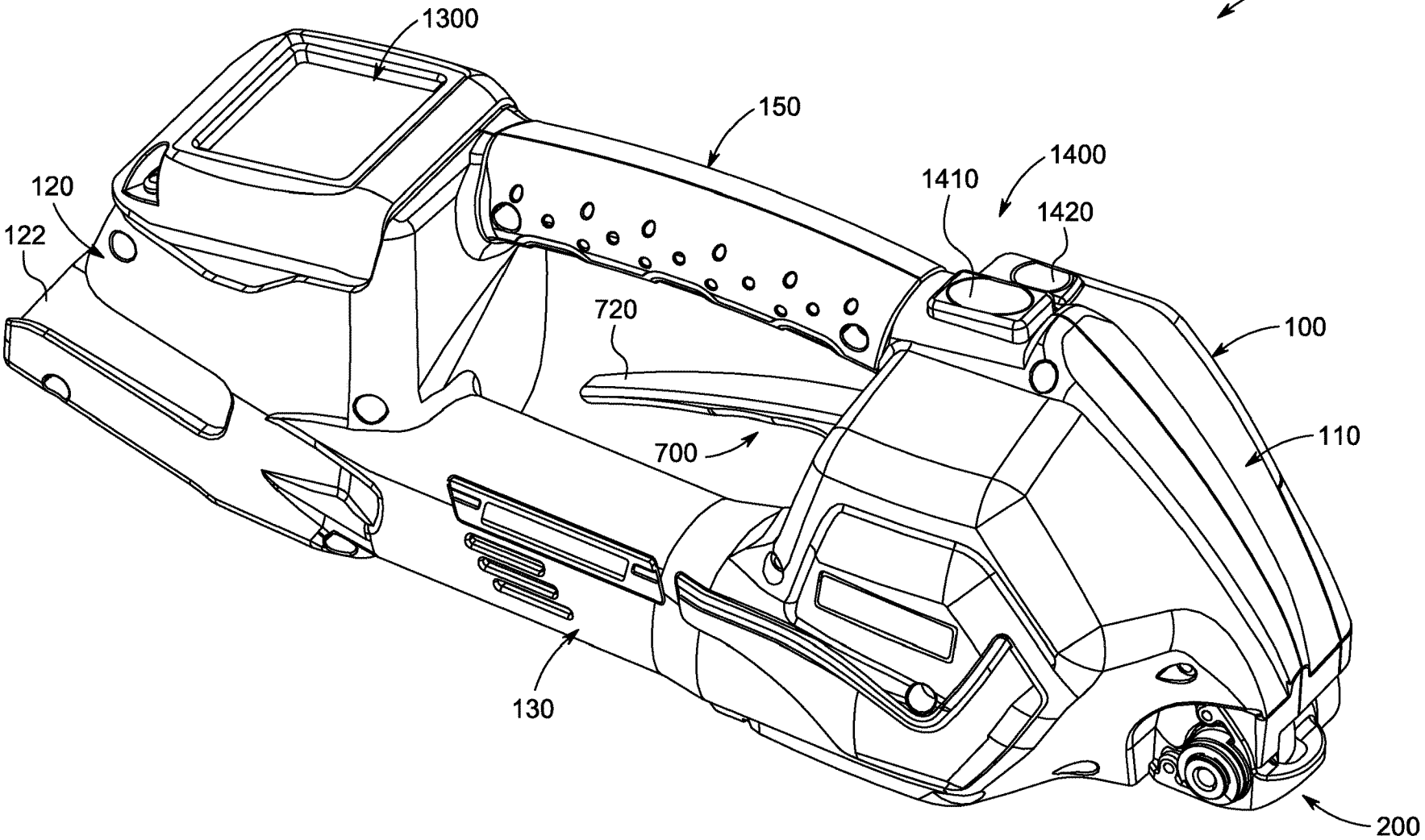
Figure 1C:
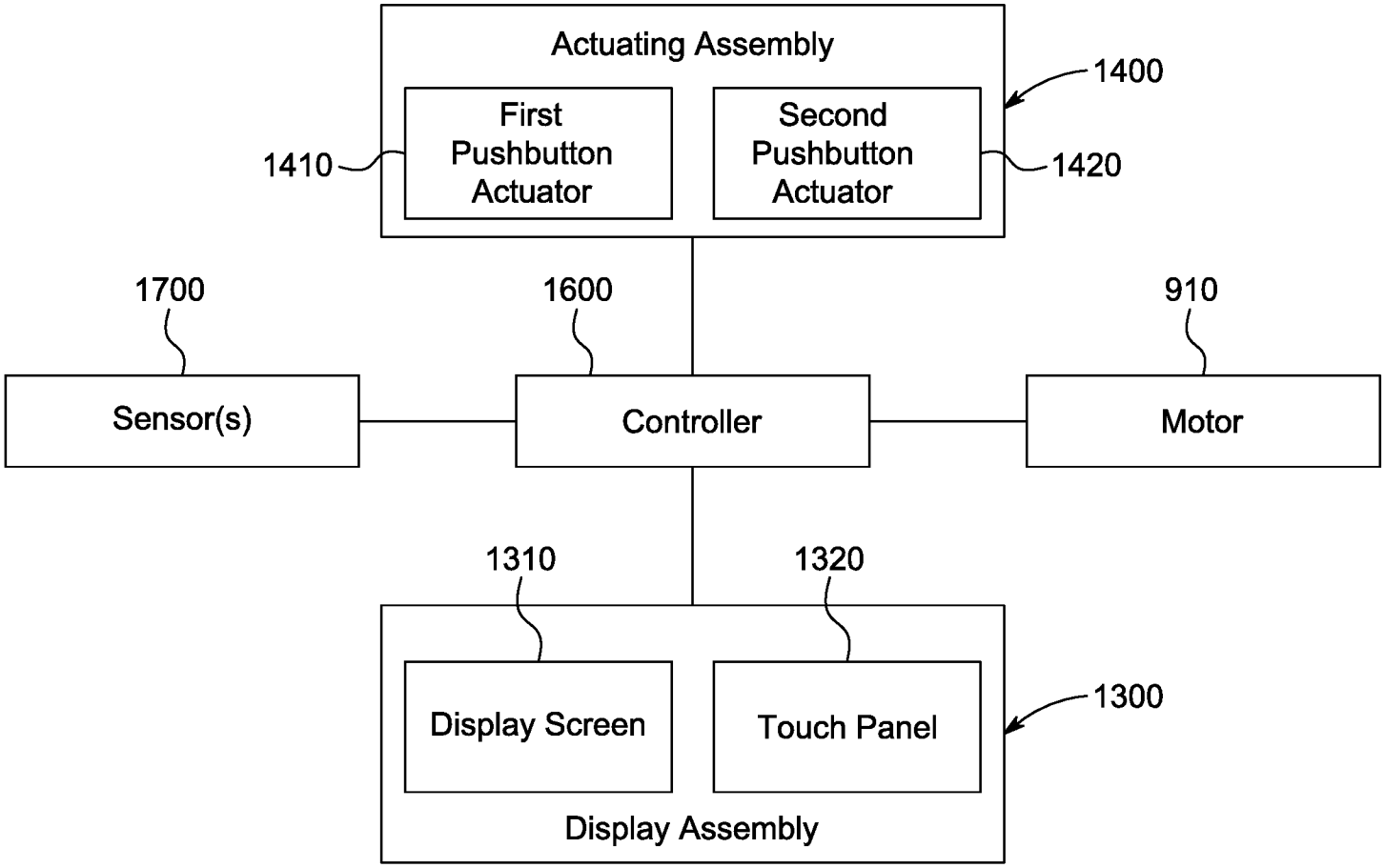
FIG. 1C is a block diagram of certain components of the strapping tool of FIGS. 1A and 1B.
Figures 2A, 2B, 2C, 2D:
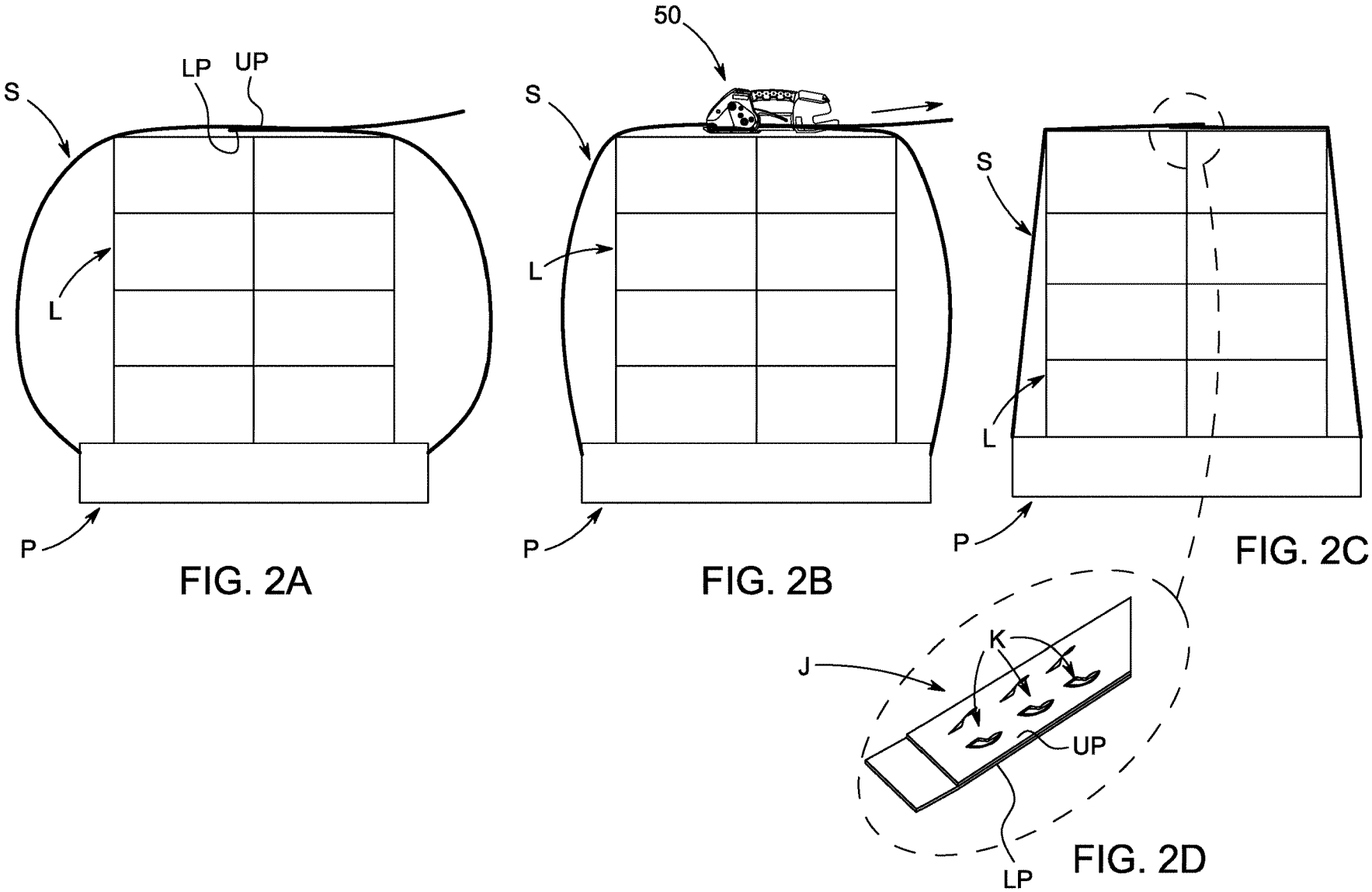
FIGS. 2A-2C are diagrammatic views of the strapping tool of FIGS. 1A and 1B securing a load to a pallet.
FIG. 2D is a perspective view of a sealless joint formed by the strapping tool of FIG. 1A to attach two overlapping portions of strap.

The strapping tool 50 includes a housing 100 (FIGS. 1A and 1B), a working assembly 200 (FIGS. 3A-3C), a display assembly 1300 (FIGS. 1A-2), an actuating assembly 1400 (FIGS. 1A-1C); a power supply (not shown); a controller 1600 (FIG. 1C), and one or more sensors 1700 (FIG. 1C).

The housing 100, which is best shown in FIGS. 1A and 1B, is formed from multiple components (not individually labeled) that collectively at least partially enclose and/or support some (or all) of the other assemblies and components of the strapping tool 50. In this example embodiment, the housing 100 includes a front housing section 110, a rear housing section 120, a motor housing section 130, and a handle section 150. The front housing section 110 at least partially encloses and/or supports at least some of the components of the working assembly 200 and the actuating assembly 1400. The rear housing section 120 at least partially encloses and/or supports at least some of the components of the display assembly 1300 and defines a receptacle 122 sized, shaped, and otherwise configured to receive and at least partially enclose and/or support the power supply and the controller 1600. The motor housing section 130 extends between and connects the bottoms of the front and rear housing sections 110 and 120 and at least partially encloses and/or supports at least some of the components of the working assembly 200 (and in particular, the motor assembly 900, as further described below). The handle housing section 150 extends between and connects the tops of the front and rear housing sections 110 and 120 and defines a handle used by the operator. This is merely one example, and in other embodiments the components of the strapping tool may be supported and/or enclosed by any suitable portion of the housing 100. The housing 100 may be formed from any suitable quantity of components joined together in any suitable manner. In this example embodiment, the housing 100 is formed from plastic, though it may be made from any other suitable material in other embodiments.

The working assembly 200, which is best shown in FIGS. 3A, 3B, and 8-9C, includes the majority of the components of the strapping tool 50 that are configured to carry out the strapping cycle to tension the strap around the load, attach the overlapping portions of the strap to one another, and cut the strap from the strap supply. Specifically, the working assembly 200 includes a support 300, a tensioning assembly 500, a sealing assembly 600, a rocker lever 700, a transmission assembly 800, a motor assembly 900, and a decoupling assembly 1900.

The support 300, which is best shown in FIGS. 3A-4B, serves as a direct or indirect common mount for the tensioning assembly 500, the sealing assembly 600, the rocker lever 700, the transmission assembly 800, the motor assembly 900, and the decoupling assembly 1900. The support 300 includes a base 310, first and second support ears 320 and 330 extending upward from the base 310, a die-assembly mounting ear (not shown) extending forward from the base 310, and a mounting shaft 390 extending through and rotatably supported by the support ears 320 and 330. The base 310 supports a tensioning plate 312 below the tensioning wheel 590 of the tensioning assembly 500 (described below) and a punch 314 below the dies 614 of the die assembly 610 (described below).

Figure 5A:
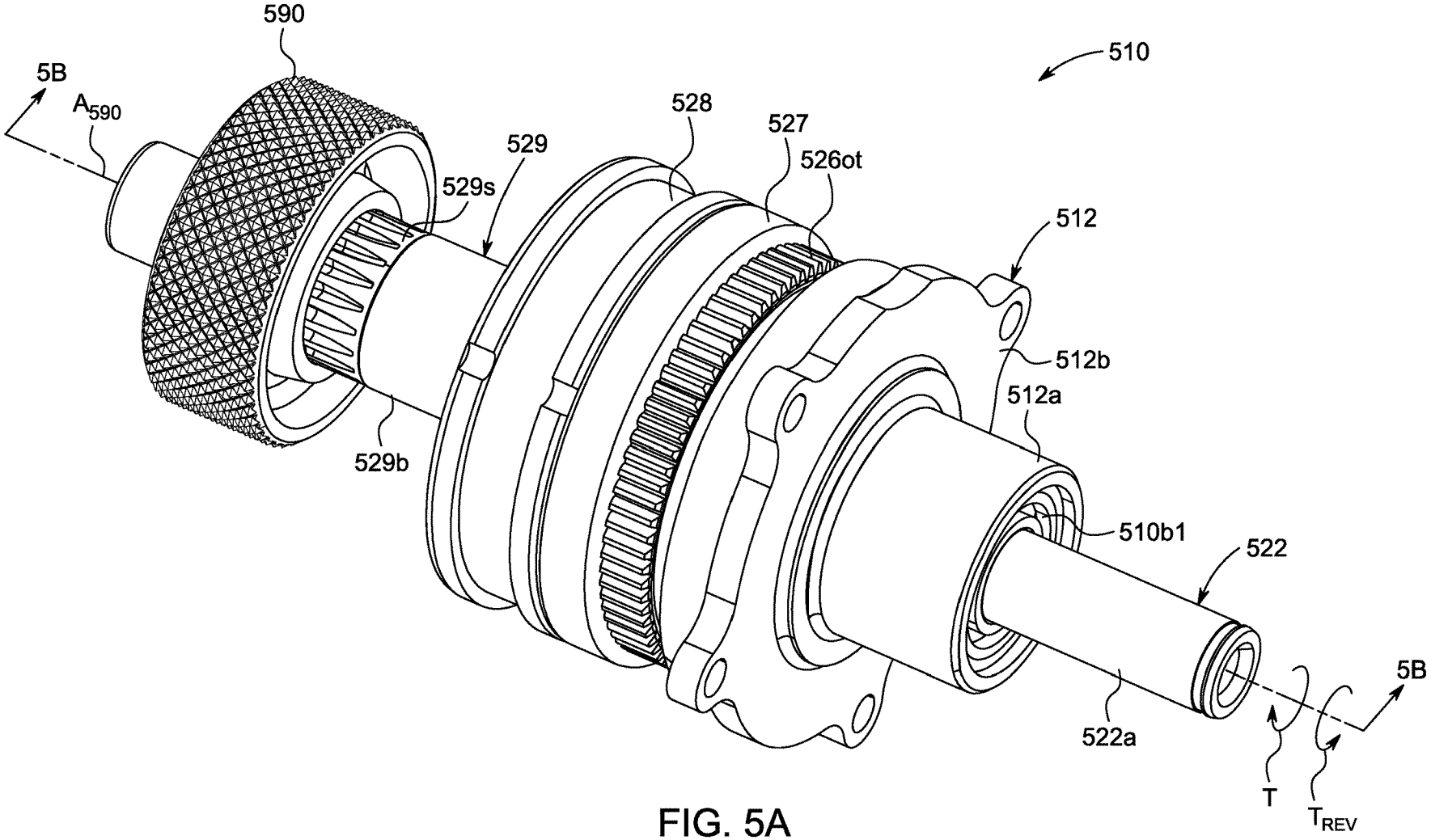
FIG. 5A is a perspective view of the tensioning-assembly gearing and the tension wheel of the tensioning assembly of the working assembly of FIGS. 3A and 3B.
Figure 5B:
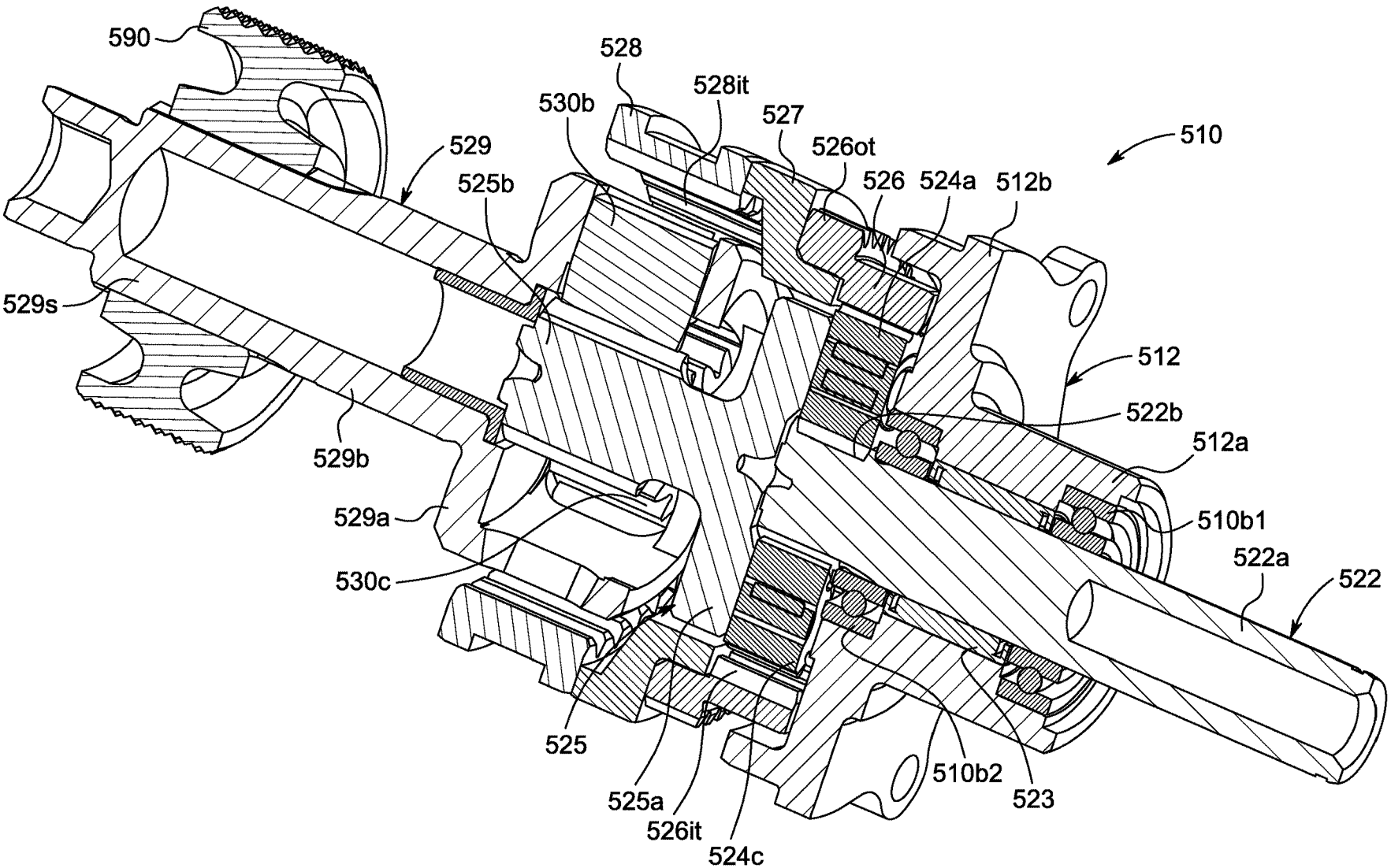
FIG. 5B is a cross-sectional perspective view of the tensioning-assembly gearing and the tension wheel of FIG. 5A taken along line 5B-5B of FIG. 5A.
Figure 5C:
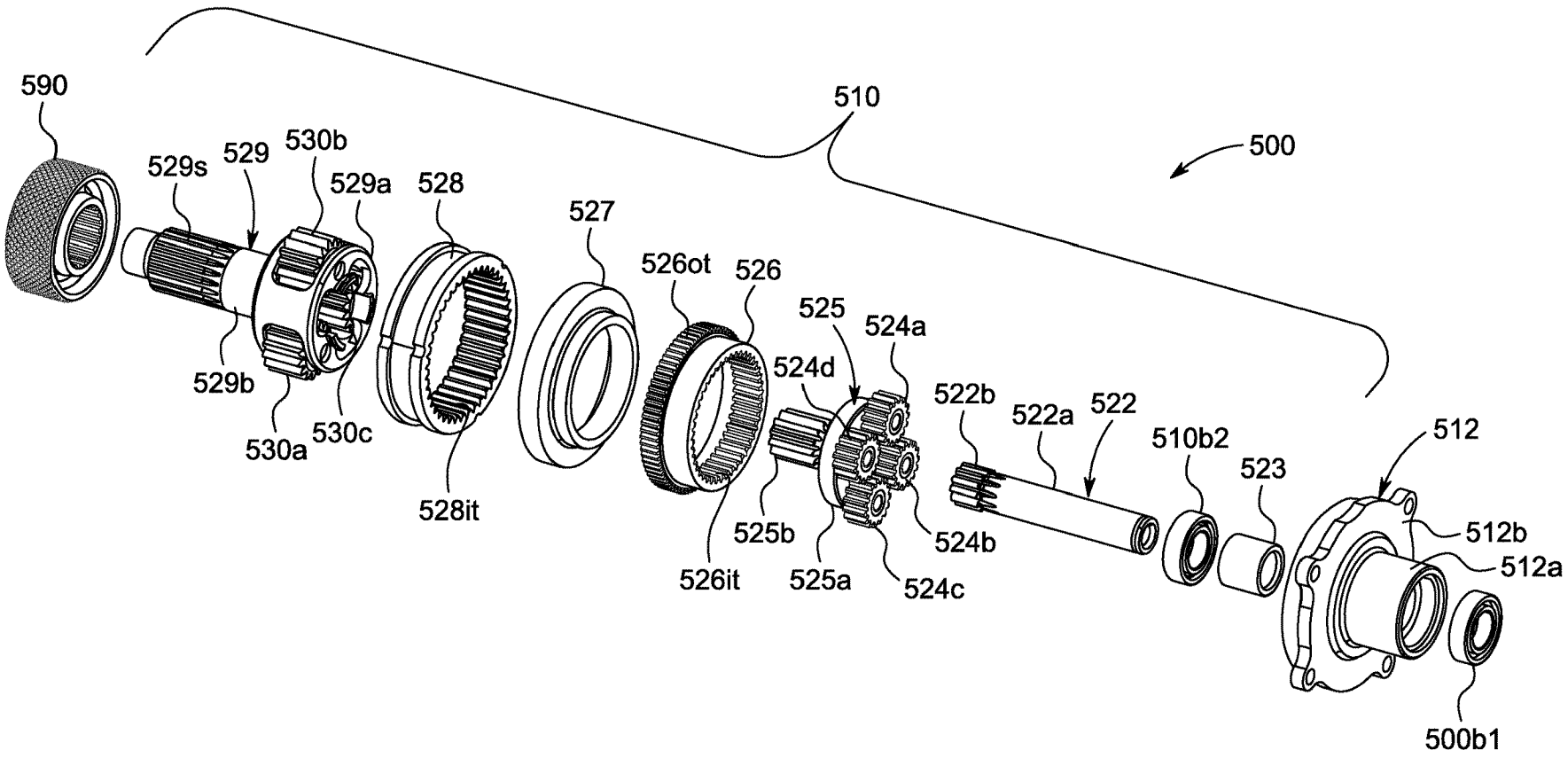
FIG. 5C is an exploded perspective view of the tensioning-assembly gearing and the tension wheel of FIG. 5A.

The tensioning assembly 500, which is best shown in FIGS. 5A-5C, is configured to tension the strap around the load during the tensioning cycle. The tensioning assembly 500 includes a tensioning-assembly support 505, tensioning-assembly gearing 510, and a tension wheel 590 driven by the tensioning-assembly gearing 510.

The tensioning-assembly gearing 510 includes: a gearing support 512; a driven shaft 522; a tensioning-assembly-gearing freewheel 523; first planet gears **524*a*, 524*b*, 524*c*, and 524*d*; a carrier 525; a first ring gear 526; a bushing 527; a second ring gear 528; a tension-wheel mount 529; and second planet gears 530***a*, 530*b*, and 530*c*. Certain components of the tensioning-assembly gearing 510 are centered on and certain components of the tensioning-assembly gearing 510 are rotatable about a tension-wheel rotational axis $A_{590}$. The gearing support 512 includes an annular support shaft 512*a* and a cover 512*b* extending radially outward from the support shaft 512*a*. The driven shaft 522 includes a shaft portion 522*a* and a first sun gear 522*b* at one end of the shaft portion 522*a*. The carrier 525 includes a first planet-gear carrier 525*a* to which the first planet gears 524*a*-524*d* are rotatably mounted (such as via respective bearings and mounting pins) and a second sun gear 525*b* rotatable with (and here integrally formed with) the planet-gear carrier 525*a* about the tension-wheel rotational axis $A_{590}$. The first ring gear 526 includes internal teeth 526*it* and external teeth 526*ot*. The second ring gear 528 includes internal teeth 528*it*. The tension-wheel mount 529 includes a second planet-gear carrier 529*a* and a tension-wheel shaft 529*b* rotatable with (and here integrally formed with) the second planet-gear carrier 529*a* about the tension-wheel rotational axis $A_{590}$. The second planet gears 530*a*-530*c* are rotatably mounted to the second planet-gear carrier 529*a* (such as via respective bearings and mounting pins). The tension-wheel shaft 529*b* includes a splined end 529*s* opposite the second planet-gear carrier 529*a* to enable the tension wheel 590 to be mounted thereon and fixed in rotation with the tension-wheel shaft 529.

The shaft portion 522*a* of the driven shaft 522 extends through and is engaged by the tensioning-assembly-gearing freewheel 523, which is itself supported by and positioned within a bore through the annular support shaft 512*a* of the gearing support 512. The tensioning-assembly-gearing freewheel 523 is configured to permit rotation of the driven shaft 522 relative to the gearing support 512 in a tensioning rotational direction—referred to as the tensioning direction T (FIG. 5A)—and to prevent rotation of the driven shaft 522 in a rotational direction opposite the tensioning direction T—referred to as the release direction $T_{REV}$ (FIG. 5A). The first sun gear 522*b* of the driven shaft 522 meshes with and drivingly engages the first planet gears 524*a*-524*d*. The first planet gears 524*a*-524*d* mesh with the internal teeth 526*it* of the first ring gear 526. The bushing 527 rotatably supports the first ring gear 526 and separates it from the second ring gear 528. The second sun gear 525*b* meshes with and drivingly engages the second planet gears 530*a*-530*c*. The second planet gears 530*a*-530*c* mesh with the internal teeth 528*it* of the second ring gear 528. The tension wheel 590 is mounted to the splined end 529*s* of the tension-wheel shaft 529*b* and held in place longitudinally via a suitable retainer such that the tension-wheel shaft 529*b* and the tension wheel 590 rotate together about the tension-wheel rotational axis $A_{590}$. Any other suitable method, such as a key, may be used to fix the tension wheel in rotation with the tension-wheel shaft.

The tensioning-assembly gearing 510 is mounted to the tensioning-assembly support 505 via attaching the cover 512*b* of the gearing support 512 to the tensioning-assembly support 505. The second ring gear 528 is fixed in rotation about the tension-wheel rotational axis $A_{590}$ relative to the tensioning-assembly support 505 (that is, the second ring gear 528 is not rotatable about the tension-wheel rotational axis $A_{590}$ relative to the tensioning-assembly support 505). In this example embodiment, pins (not shown) are positioned between the outer surface of the second ring gear 528 and the tensioning-assembly support 505 to prevent relative rotation, though any suitable components (such as set screws, adhesive, high-friction components, or fasteners) may be used to do so. The decoupling assembly 1900 (except when actuated, as described below) fixes the first ring gear 526 in rotation about the tension-wheel rotational axis $A_{590}$ relative to the tensioning-assembly support 505 so the first ring gear 526 cannot rotate about the tension-wheel rotational axis $A_{590}$ relative to the tensioning-assembly support 505.

During the tensioning cycle, the motor assembly 900 and transmission assembly 800 drive the driven shaft 522 in the tensioning direction T, as described below. This causes the first sun gear 522*b* to rotate about the tension-wheel rotational axis $A_{590}$ in the tensioning direction T. The first sun gear 522*a* drives the first set of planet gears 524*a*-524*dc*. Since the decoupling assembly 1900 prevents the first ring gear 526 from rotating about the tension-wheel rotational axis $A_{590}$, rotation of the planet gears 524*a*-524*d* causes the carrier 525—including the second sun gear 525*b*—to rotate about the tension-wheel rotational axis $A_{590}$ in the tensioning direction T. The second sun gear 525*b* drives the second set of planet gears 530*a*-530*c*. Since the second ring gear 528 cannot rotate about the tension-wheel rotational axis $A_{590}$, rotation of the planet gears 530*a*-530*c* causes the tension-wheel mount 529 and the tension wheel 590 mounted thereto to rotate about the tension-wheel rotational axis $A_{590}$ in the tensioning direction T. Accordingly, the tensioning-assembly gearing 510 operatively connects the motor assembly 900 and the transmission assembly 800 to the tension wheel 590 to rotate the tension wheel 590 about the tension-wheel rotational axis $A_{590}$ in the tensioning direction T.

Figure 4A:
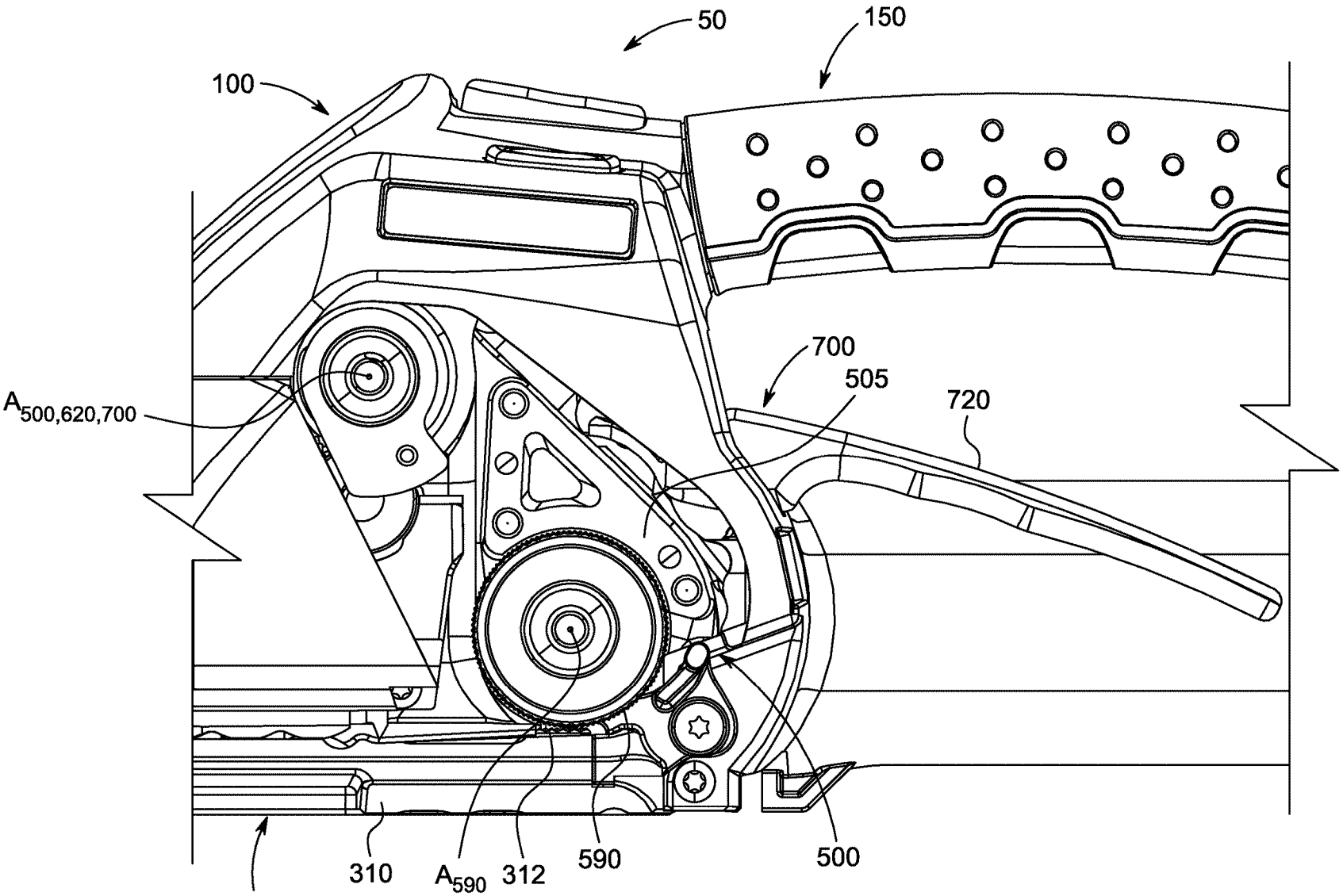
FIG. 4A is a partial side view of the strapping tool of FIGS. 1A and 1B with part of the front housing section of the housing removed and with the tensioning assembly in the strap-tensioning position.
Figure 4B:
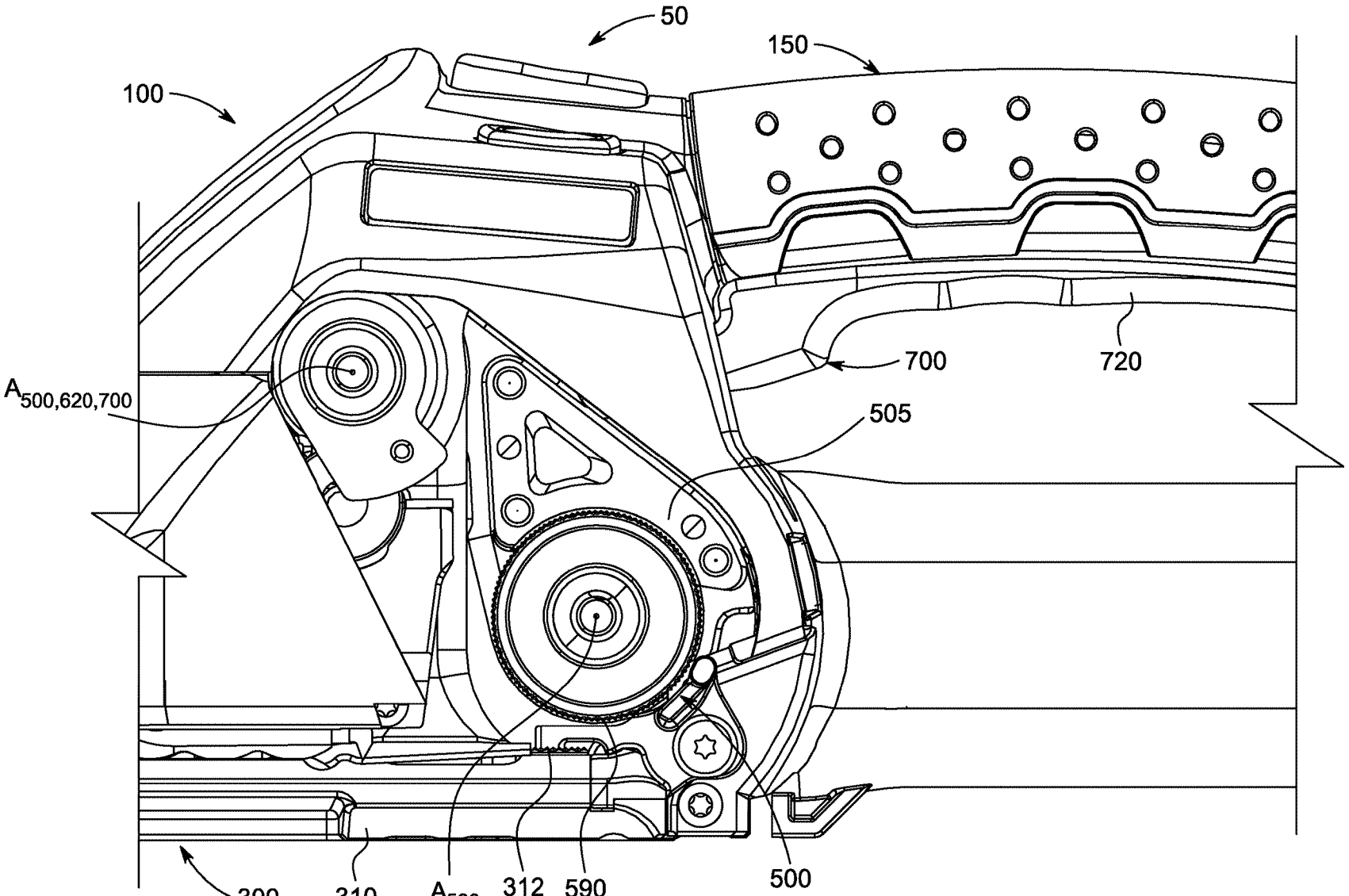
FIG. 4B is a partial side view similar to FIG. 4A but with the tensioning assembly in the strap-insertion position.

The tensioning assembly 500 is movably mounted to the mounting shaft 390 of the support 300 and configured to pivot relative to the support 300—and particularly relative to the base 310 of the support 300—under control of the rocker lever 700 (as described below) and about a tensioning-assembly-pivot axis $A_{500}$ between a strap-tensioning position (FIG. 4A) and a strap-insertion position (FIG. 4B). When the tensioning assembly 500 is in the strap-tensioning position, the tension wheel 590 is adjacent to the tensioning plate 312 of the support 300 (or the upper surface of the upper portion of the strap if the strap has been inserted into the strapping tool 50). When the tensioning assembly 500 is in the strap-insertion position, the tension wheel 590 is spaced-apart from the tensioning plate 312 to enable the overlapping upper and lower portions of the strap to be inserted between the tension wheel 590 and the tensioning plate 312. One or more springs or other biasing elements (not shown) bias the tensioning assembly 500 to the strap-tensioning position.

Figure 6A:
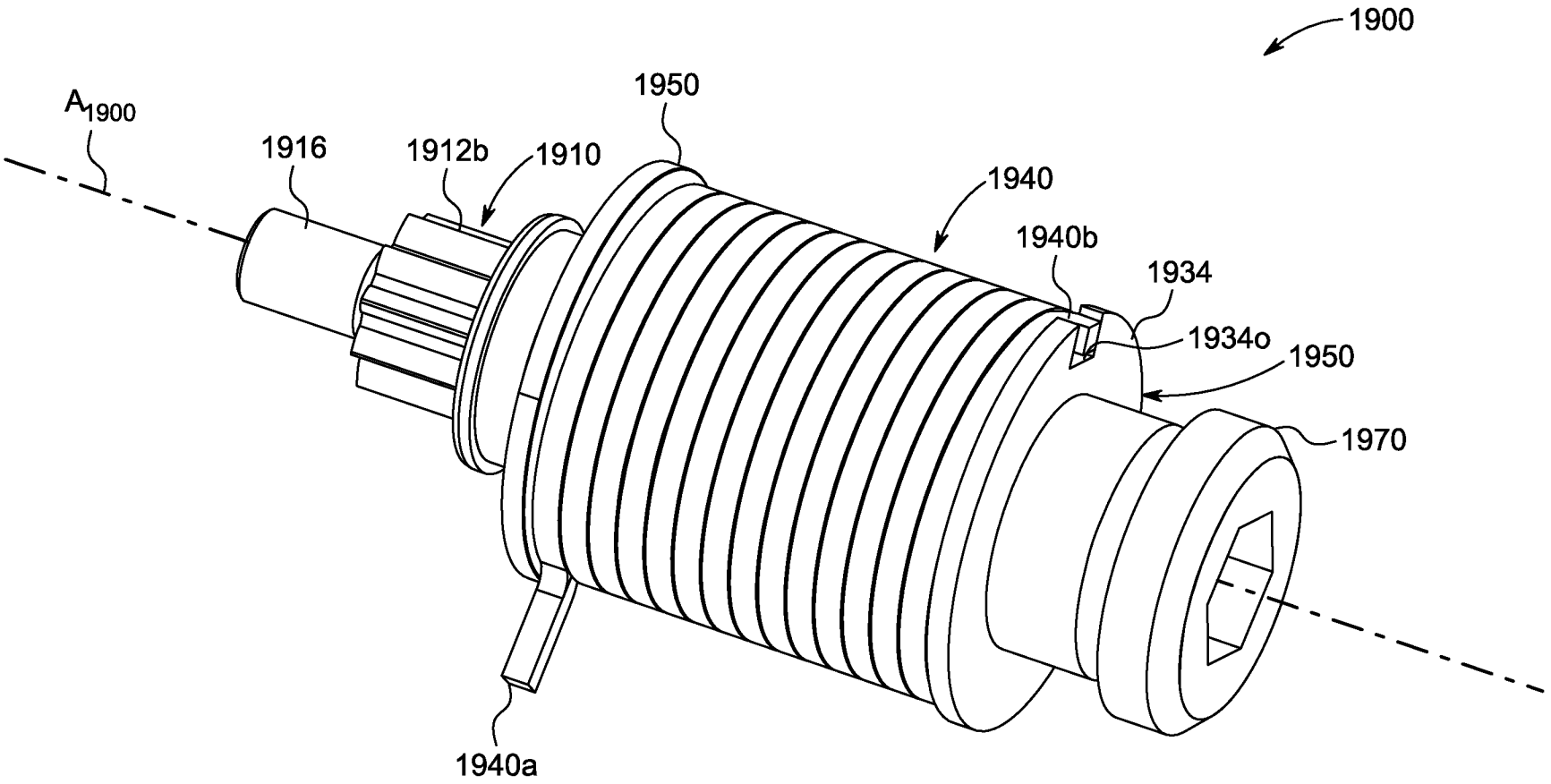
FIG. 6A is a perspective view of the decoupling assembly of the working assembly of FIGS. 3A and 3B.
Figure 6B:
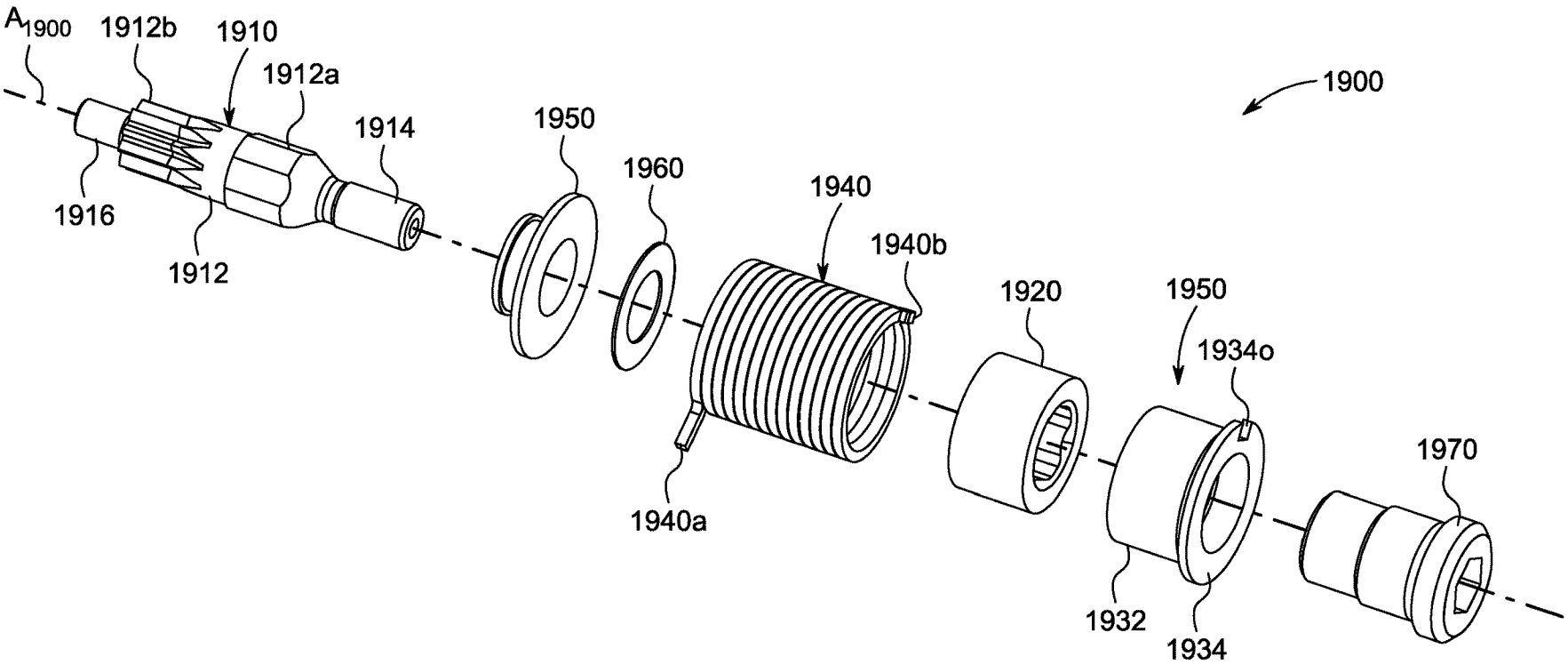
FIG. 6B is an exploded perspective view of the decoupling assembly of FIG. 6A.
Figure 6C:
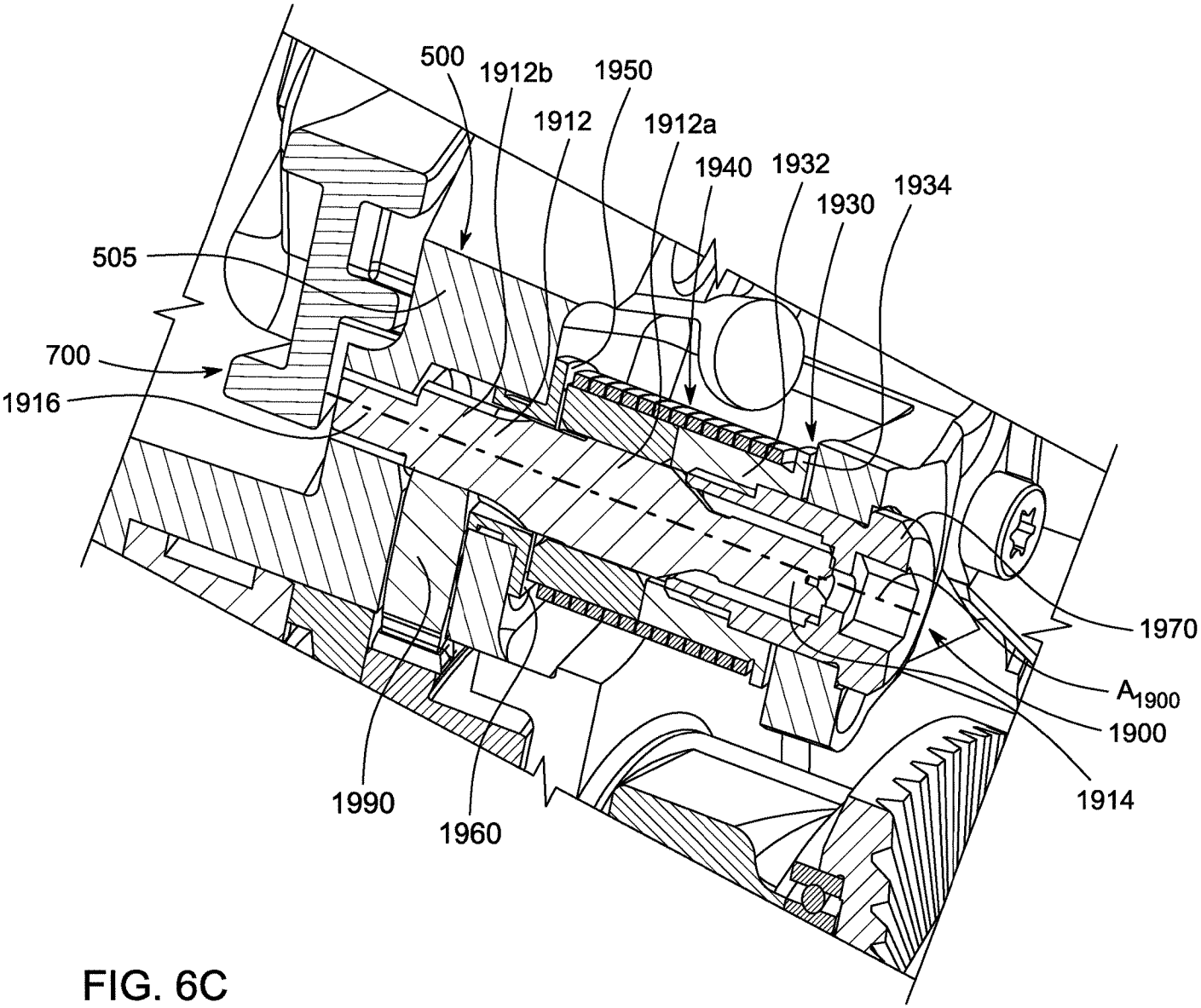
FIG. 6C is a cross-sectional perspective view of part of the working assembly of FIGS. 3A and 3B taken along line 6C-6C of FIG. 3B, which extends through the decoupling assembly of FIG. 6A.

The decoupling assembly 1900, which is best shown in FIGS. 6A-6C, is configured to (when actuated) enable the tension wheel 590 to rotate about the tension-wheel rotational axis $A_{590}$ in the release direction $T_{REV}$—i.e., the rotational direction opposite the tensioning direction T—to release tension in the strap after completion of the tensioning cycle but before completion of the sealing cycle. The decoupling assembly 1900 includes a decoupling-assembly shaft 1910, a first engageable element 1920, a second engageable element 1930, an expandable element 1940, a retainer 1950, a washer 1960, and a threaded fastener 1970.

The decoupling-assembly shaft 1910 includes a body 1912 having a first end 1912*a* having an irregular cross-section and second end 1912*b* having radially extending teeth around its circumference. A first support 1914 extends from the first end 1912*a*, and a second support 1916 extends from the second end 1912*b*. The first engageable element 1920 comprises a tubular bushing having a cylindrical outer surface and an interior surface having a perimeter that matches the perimeter of the first end 1912*a* of the body 1912 of the decoupling-assembly shaft 1910. The second engageable element 1930 includes a tubular body 1932 and an annular flange 1934 at one end of the body 1932. An opening 1934*o* is defined through the flange 1934. The expandable element 1940 includes a torsion spring having a first end 1940*a* and a second end 1940*b*.

As best shown in FIGS. 6A and 6C, the first engageable element 1920 is mounted on the first end 1912*a* of the body 1912 of the decoupling-assembly shaft 1910 for rotation therewith about a decoupling-assembly rotational axis $A_{1900}$. The second engageable element 1930 circumscribes the first support 1914 of the body 1912 of the decoupling-assembly shaft 1910 and is positioned such that the body 1932 is adjacent and coaxial with the first engageable element 1920. The expandable element 1940, which is a torsion spring in this example embodiment, circumscribes the first engageable element 1920 and the body 1932 of the second engageable element 1930. The outer diameters of the first engageable element 1920 and the body 1932 of the second engageable element 1930 are substantially the same and are equal to or larger than the resting inner diameter of the torsion spring 1940. This means that the torsion spring 1940 exerts a compressive force on the first engageable element 1920 and the body 1932 of the second engageable element 1930 that prevents those components (and the decoupling-assembly shaft 1910) from rotating relative to one another about the decoupling-assembly rotational axis $A_{1900}$. The second end 1940*b* of the expandable element 1940 is received in the opening 1934*o* defined through the flange 1934 of the second engageable element 1930.

As best shown in FIG. 6C, the decoupling assembly 1900 is mounted to the tensioning-assembly support 505 and operatively connected to the tensioning-assembly gearing 510. More specifically, the decoupling assembly 1900 is mounted to the tensioning-assembly support 505 via the fastener 1970, which fixes the second engageable element 1930 in rotation relative to the tensioning-assembly support 505 such that the second engageable element 1930—and the second end 1940*b* of the expandable element 1940 received in the opening 1934*o* of the flange 1934 of the second engageable element 1930—cannot rotate relative to the tensioning-assembly support 505 about the decoupling-assembly rotational axis $A_{1900}$. The retainer 1950 and washer 1960 separate the first engageable element 1920 from the tensioning-assembly support 505. An intermediary gear 1990 mounted to (and freely rotatable relative to) the tensioning-assembly support 505 operably connects the body 1912 of the decoupling-assembly shaft 1910 to the first ring gear 526 of the tensioning-assembly gearing 510. Specifically, the teeth on the second end 1912*b* of the body 1912 of the decoupling-assembly shaft 1910 mesh with teeth of the intermediary gear 1990, which also mesh with the outer teeth 526*ot* of the first ring gear 526 of the tensioning-assembly gearing 510 of the tensioning assembly 500. Since the body 1932 is fixed in rotation relative to the tensioning-assembly support 505 and the decoupling-assembly shaft 1910 is fixed in rotation with the first engageable element 1920, the decoupling-assembly shaft 1910—and thus the intermediary gear 1990—is fixed in rotation relative to the tensioning-assembly support 505. Since the intermediary gear 1990 meshes with the outer teeth 526*ot* of the first ring gear 526 of the tensioning-assembly gearing 510, the decoupling assembly 1900 prevents the first ring gear 526 from rotating about the tension-wheel rotational axis $A_{590}$.

The decoupling assembly 1900 is actuatable (such as by the rocker 700 as described below) to eliminate the connection between the torsion spring 1940 and the first engageable element 1920 such that the first engageable element 1920 and the decoupling-assembly shaft 1910 may rotate relative to the second engageable element 1930 about the decoupling-assembly rotational axis $A_{1900}$. As explained above, the second engageable element 1930 and the second end 1940*b* of the expandable element 1940 (that is received in the opening 1934*o* of the flange 1934 of the second engageable element 1930) are fixed in rotation relative to the tensioning-assembly support 505. To eliminate the connection between the torsion spring 1940 and the first engageable element 1920, the first end 1940*a* of the torsion spring 1940 is rotated decoupling-assembly rotational axis $A_{1900}$ relative to the tensioning-assembly support 505, the second end 1940*b* of the torsion spring 1940, and the second engageable element 1930 (such as via moving the rocker lever 700 from the home position to the intermediate position). As this occurs, the inner diameter of the torsion spring 1940 near its first end 1940*a* begins expanding, and eventually expands enough (thereby reducing the compression force or eliminating it altogether) to enable the first engageable element 1920 and the decoupling-assembly shaft 1910 to rotate decoupling-assembly rotational axis $A_{1900}$ relative to the second engageable element 1930 (and the torsion spring 1940).

Upon completion of the tensioning cycle, the tension wheel 590 holds a significant amount of tension in the strap, and the strap exerts a counteracting force (or torque) on the tension wheel 590 in the release direction $T_{REV}$. Actuation of the decoupling assembly 1900 enables the tension wheel 590 to rotate in the release direction $T_{REV}$ to release that tension in a controlled manner. Specifically, upon completion of the tensioning cycle, the decoupling-assembly shaft 1910 (via the intermediary gear 1990) continues to prevent the first ring gear 526 of the tensioning-assembly gearing 510 from rotating about the tension-wheel rotational axis $A_{590}$, which prevents the tension wheel 590 from rotating in the release direction $T_{REV}$ T. As the first end 1940*a* of the torsion spring 1940 is rotated about the decoupling-assembly rotational axis $A_{1900}$, the inner diameter of the torsion spring 1940 near its first end 1940*a* begins expanding. Eventually, the force the first ring gear 526 exerts on the decoupling-assembly shaft 1910 exceeds the compression force the torsion spring 1940 exerts on the first engageable element 1920. When this occurs, the first ring gear 526 rotates in the release direction $T_{REV}$ about the tension-wheel rotational axis $A_{590}$. Since the tensioning-assembly-gearing freewheel 523 prevents the driven shaft 522—including the first sun gear 522*b*—from rotating in the release direction $T_{REV}$, this causes the first planetary gears 524*a*-524*d* to rotate in the release direction $T_{REV}$ about the tension-wheel rotational axis $A_{590}$. This (as explained above) causes the tension wheel 590 to rotate in the release direction $T_{REV}$ about the tension-wheel rotational axis $A_{590}$.

In other embodiments, the second end of the body of the decoupling-assembly shaft directly meshes with the outer teeth of the first ring gear (rather than via one or more intermediary gears).

The rocker lever 700, which is best shown in FIGS. 3A-4B, is operably connected to: (1) the tensioning assembly 500 and configured to move the tensioning assembly 500 relative to the support 300 from the strap-tensioning position to the strap-insertion position; and (2) the decoupling assembly 1900 and configured to actuate the decoupling assembly, thereby enabling the tension wheel 590 to rotate in the release direction $T_{REV}$. The rocker lever 700 includes a mounting head 710, a body 720 connected to the mounting head 710, and a decoupling-assembly actuator 730 (a pin in this example embodiment) extending transversely from the body 720.

The mounting head 710 is pivotably mounted to the mounting shaft 390 of the support 300 such that the rocker lever 700 is pivotable relative to the support 300 about a rocker-lever pivot axis $A_{700}$ (which in this example embodiment is the same as the tensioning-assembly-pivot axis $A_{500}$). The rocker lever 700 is also mounted to the tensioning assembly 500 via pin 700*p* that extends through the tensioning-assembly support 505 and a slot (not shown) defined through the body 720 of the rocker lever 700. The slot is sized, shaped, and oriented such that the rocker lever 700 is pivotable about the tensioning-assembly-pivot axis $A_{500}$: (1) relative to the support 300, the tensioning assembly 500, and the decoupling assembly 1900 from a home position (FIGS. 3A-4A) to an intermediate position (not shown) to actuate the decoupling assembly 1900; and (2) relative to the support 300 from the intermediate position (not shown) to an actuated position (FIG. 4B). A rocker-lever biasing element (not shown), such as a spring, biases the rocker lever to the home position.

More specifically, when the rocker lever 700 is in the home position, as shown in FIGS. 3A-4A, the tensioning assembly 500 is in its strap-tensioning position. As the rocker lever 700 moves relative to the support 300, the tensioning assembly 500, and the decoupling assembly 1900 to the intermediate position, the decoupling-assembly actuator 730 engages the first end 1940*a* of the torsion spring 1940 of the decoupling assembly 1940 and rotates that first end relative to the tensioning-assembly support 505, the second end 1940*b* of the torsion spring 1940, and the first and second engageable elements 1920 and 1930. As this occurs, the inner diameter of the torsion spring 1940 near its first end 1940*a* begins expanding, and eventually expands enough (thereby reducing the compression force or eliminating it altogether) to enable the first engageable element 1920 and the decoupling-assembly shaft 1910 to rotate relative to the second engageable element 1930 and the torsion spring 1940. After the rocker lever 700 reaches the intermediate position, continued movement of the rocker lever 700 toward the actuated position causes the tensioning assembly 500 to begin pivoting with the rocker lever 700, culminating in the rocker lever 700 reaching the actuated position and the tensioning assembly 500 reaching the strap-insertion position.

Figure 3A:
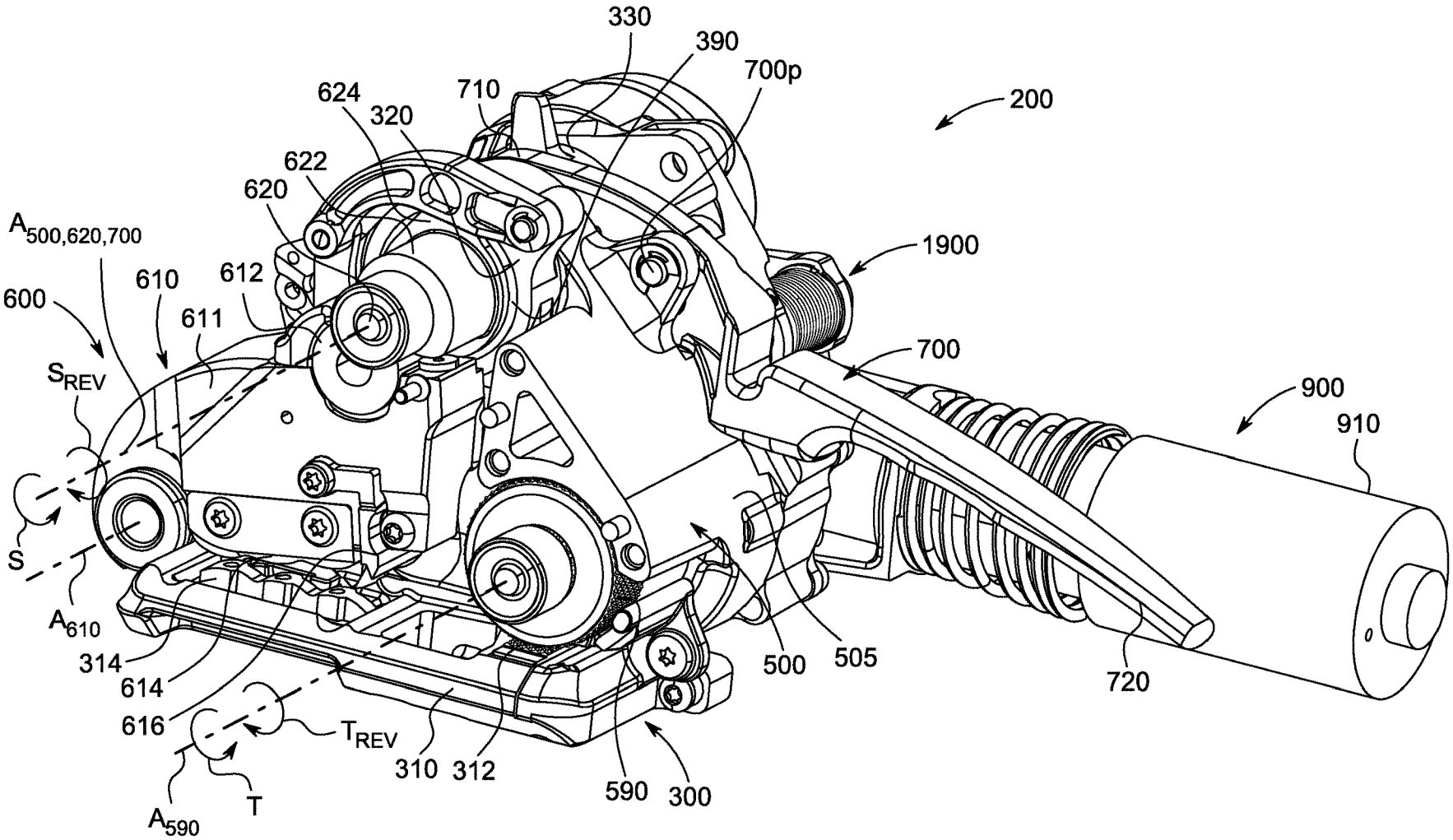
FIGS. 3A and 3B are perspective views of the working assembly of the strapping tool of FIGS. 1A and 1B.
Figure 3B:
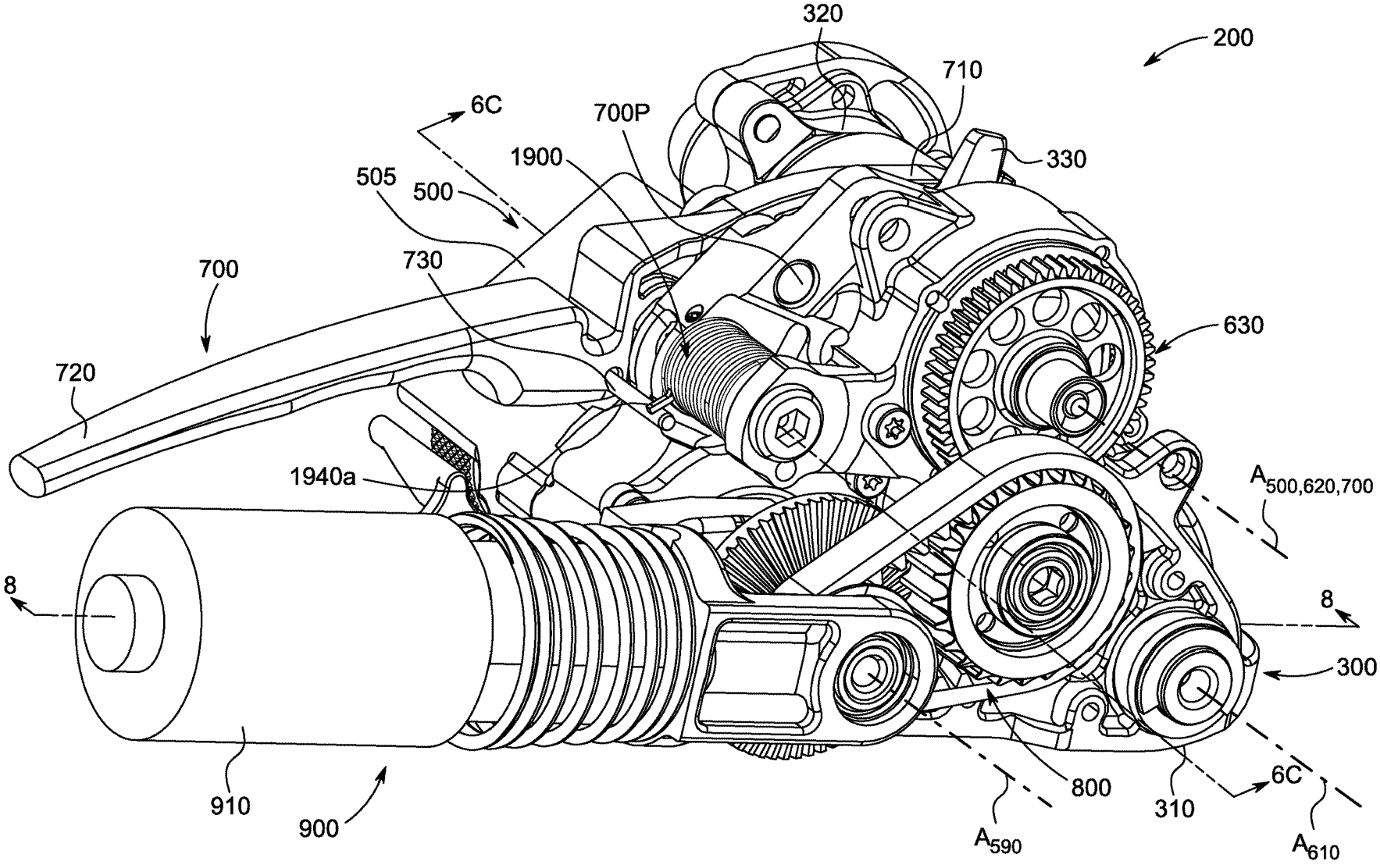

The sealing assembly 600, which is best shown in FIGS. 3A and 3B, is configured to attach overlapping portions of the strap to one another to form a tensioned strap loop around the load during the sealing cycle by forming a set of mechanically interlocking cuts in the overlapping portions of the strap to attach them to one another. The sealing assembly 600 includes a die assembly 610, a camshaft 620 including first and second variable-diameter cams 622 and 624, and sealing-assembly gearing 630. The die assembly 610 includes a body 611 including a first cam follower 612 on an upper surface of the body 611, a second cam follower (not shown), dies 614 on an underside of the body 611, and a cutter 616 rearward of the dies 614. The die assembly 610 is movably mounted to the die-assembly mounting ear of the support 300 and configured to pivot relative to the support 300—and particularly relative to the base 310 of the support 300—under control of the first and second cams 622 and 624 of the camshaft 620 and about a die-assembly-pivot axis $A_{610}$ between a home position (FIG. 3A) and a sealing position (not shown). A die-assembly biasing element (not shown) biases the die assembly 610 to the home position. The sealing-assembly gearing 630 operably connects the transmission assembly 800 and the motor assembly 900 to the camshaft 620, which extends through and the mounting shaft 390 of the support 300 (and is supported by bearings or other suitable components) and 330 and is rotatable about the tensioning-assembly pivot axis $A_{500}$. The first cam 622 engages the cam follower 612, and the second cam 624 engages the second cam follower. The die-assembly biasing element biases the first cam follower 612 into contact with the first cam 622.

In operation, the motor assembly 900 and the transmission assembly 800 drive the camshaft 620 and the cams 622 and 624 thereon to rotate about a camshaft rotational axis $A_{620}$ (which in this example embodiment is the same as the tensioning-assembly and rocker-lever pivot axes $A_{500}$ and $A_{700}$) in a sealing rotational direction S—referred to herein as the sealing direction S (FIG. 3A). The first cam 622 is shaped such that as it rotates it applies a downward force on the first cam follower 612, which pivots the die assembly 610 toward the base 310 of the support 300 as the die assembly 610 moves toward its sealing position. As the die assembly 610 moves toward its sealing position, the dies 614 engage the upper portion of strap and forces the lower portion of strap against the punch 314 of the base 310 of the support 300. As the die assembly 610 continues to move toward and reaches its sealing position, the dies 614 and punch 314 combine to cut keys in the overlapping upper and lower portions of strap, and the cutter 616 cuts the upper portion from the strap supply. Continued rotation of the cams 622 and 624 reverses this movement to return the die assembly 610 to its home position.

Figure 8:
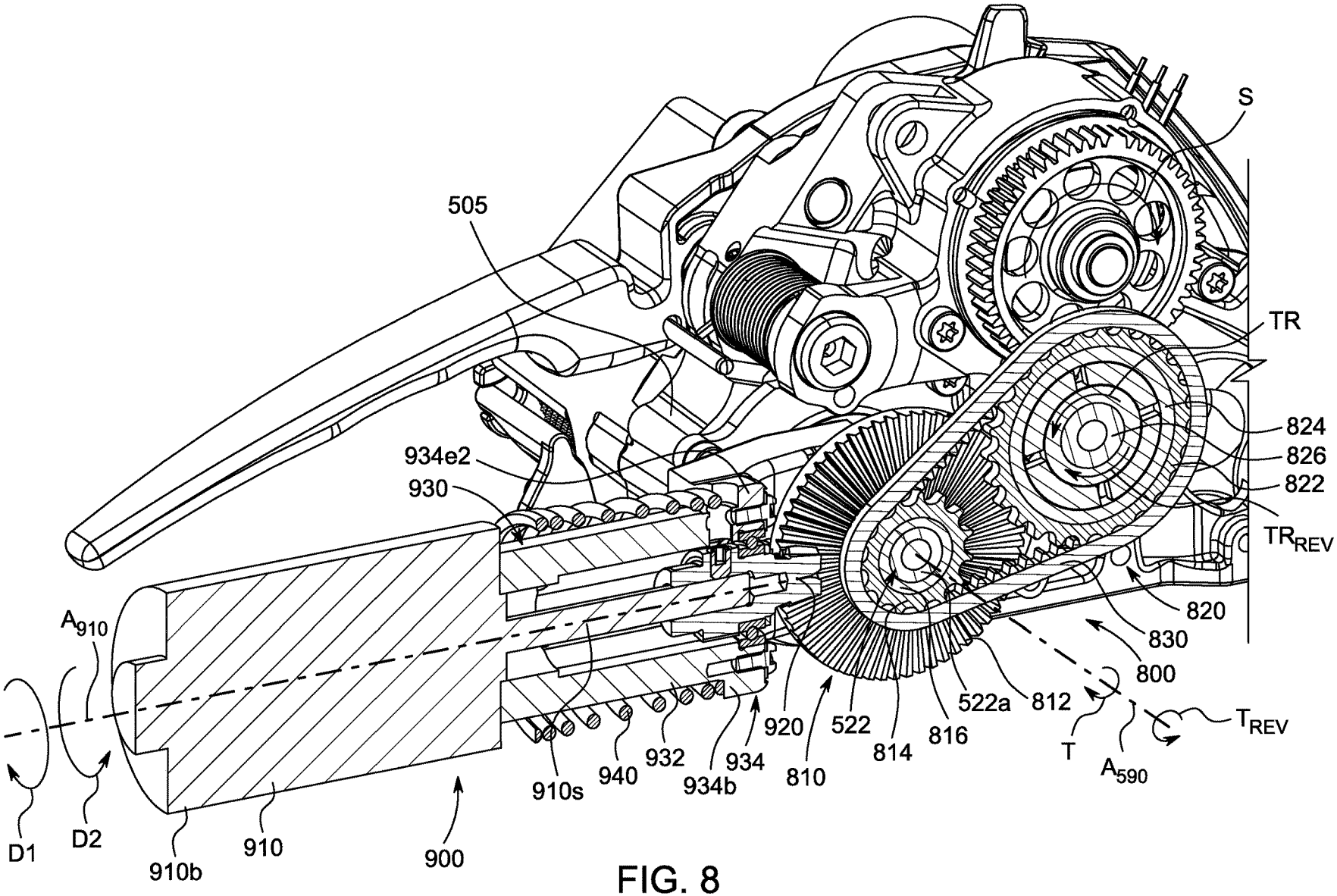
FIG. 8 is a cross-sectional perspective view of the working assembly of FIGS. 3A and 3B taken along line 8-8 of FIG. 3B, which extends through the motor assembly of FIG. 7 and the transmission assembly of the working assembly.

The transmission assembly 800, which is best shown in FIG. 8, is driven by the motor assembly 900, is operably connected to the tensioning assembly 500 and configured to cause the tension wheel 590 to rotate in the tensioning direction T to tension the strap, and is operably connected to the sealing assembly 600 and configured to cause the sealing assembly 600 to attach the overlapping portions of the strap to one another. The transmission assembly 800 includes a first transmission-gear assembly 810, a second transmission-gear assembly 820, and a connector 830.

The first transmission-gear assembly 810 includes a first driven gear 812 (which is a bevel gear in this example embodiment but may be any suitable gear), a second-gear-assembly drive gear 814 (which is a spur gear in this example embodiment but may be any suitable gear), and a first transmission freewheel 816. The first transmission freewheel 816 is mounted to, engages, and circumscribes the shaft portion 522*a* of the driven shaft 522 of the tensioning-assembly gearing 510 of the tensioning assembly 500. The first driven gear 812 and the second-gear-assembly drive gear 814 are fixed in rotation with one another (so they rotate together) and are mounted to, engage, and circumscribe the first transmission freewheel 816. The first transmission freewheel 816 is configured to: (1) transmit rotational movement of the first driven gear 812 and the second-gear-assembly drive gear 814 in the tensioning direction T to the driven shaft 522 such that the first driven gear 812, the second-gear-assembly drive gear 814, and the driven shaft 522 rotate together in the tensioning direction T about the tension-wheel rotational axis $A_{590}$; and (2) not transmit rotational movement of the first driven gear 812 and the second-gear-assembly drive gear 814 in the release direction $T_{REV}$ to the driven shaft 522 such that the first driven gear 812 and the second-gear-assembly drive gear 814 rotate about the tensioning rotational axis $A_{590}$ in the release direction $T_{REV}$ relative to and around the first transmission freewheel 816 and the driven shaft 522.

The second transmission-gear assembly 820 includes a second driven gear 822 (which is a spur gear in this example embodiment but may be any suitable gear), a second transmission freewheel 824, and a sealing-assembly drive gear 826 (which is a spur gear in this example embodiment but may be any suitable gear) having an elongated shaft. The second transmission freewheel 824 is mounted to, engages, and circumscribes the elongated shaft of the sealing-assembly drive gear 826. The second driven gear 822 is mounted to, engages, and circumscribes the second transmission freewheel 824. The second transmission freewheel 824 is configured to: (1) transmit rotational movement of the second driven gear 822 in a transmission rotational direction TR—referred to herein as the transmission direction TR (FIG. 8)—to the sealing-assembly drive gear 826 such that the second driven gear 822 and the sealing-assembly drive gear 826 rotate together in the transmission direction TR; and (2) not transmit rotational movement of the second driven gear 822 in a rotational direction opposite the transmission direction TR—referred to herein as the non-transmission direction $TR_{REV}$ (FIG. 8)—to the sealing-assembly drive gear 826 such that the second driven gear 822 rotates in the non-transmission direction $TR_{REV}$ relative to and around the second transmission freewheel 824 and the sealing-assembly drive gear 826. Although not shown, the sealing-assembly drive gear 826 is operably connected to the sealing-assembly gearing 630 and configured to drive the sealing-assembly gearing 630 to rotate the camshaft 620 in the sealing direction S.

The connector 830, which is a toothed belt in this example embodiment but may be any suitable connector, operably connects the second-gear-assembly drive gear 814 of the first transmission-gear assembly 810 and the second driven gear 822 of the second transmission-gear assembly 820.

This is merely one example transmission assembly, and the strapping tool may include any suitable transmission assembly or assemblies operably connecting one or more motors to the tensioning and sealing assemblies to drive those assemblies.

In operation, the motor assembly 900 can drive the first driven gear 812 of the first transmission-gear assembly 810 of the transmission assembly 800 in either the tensioning direction T or the release direction $T_{REV}$. When the motor assembly 900 drives the first driven gear 812 in the tensioning direction T, the first driven gear 812, the second-gear-assembly drive gear 814 and the driven shaft 522 rotate together in the tensioning direction T about the tension-wheel rotational axis $A_{590}$. The connector 830 transmits the rotation of the second-gear-assembly drive gear 814 to the second driven gear 822 of the second transmission-gear assembly 820, causing it to rotate in the non-transmission direction $TR_{REV}$ around the second transmission freewheel 824, which does not transmit this rotational movement to the sealing-assembly drive gear 826. On the other hand, when the motor assembly 900 drives the first driven gear 812 in the release direction $T_{REV}$, the first driven gear 812 and the second-gear-assembly drive gear 814 rotate in the release direction $T_{REV}$ around the first transmission freewheel 816, which does not transmit this rotational movement to the driven shaft 522. The connector 830 transmits the rotation of the second-gear-assembly drive gear 814 to the second driven gear 822 of the second transmission-gear assembly 820, causing it to rotate in the transmission direction TR. The second transmission freewheel 824 transmits this rotational movement to the sealing-assembly drive gear 826, which rotates in the transmission direction TR (FIG. 8) and drives the sealing-assembly gearing 630 to rotate the camshaft 620 in the sealing direction S (FIG. 3A).

Figure 7:
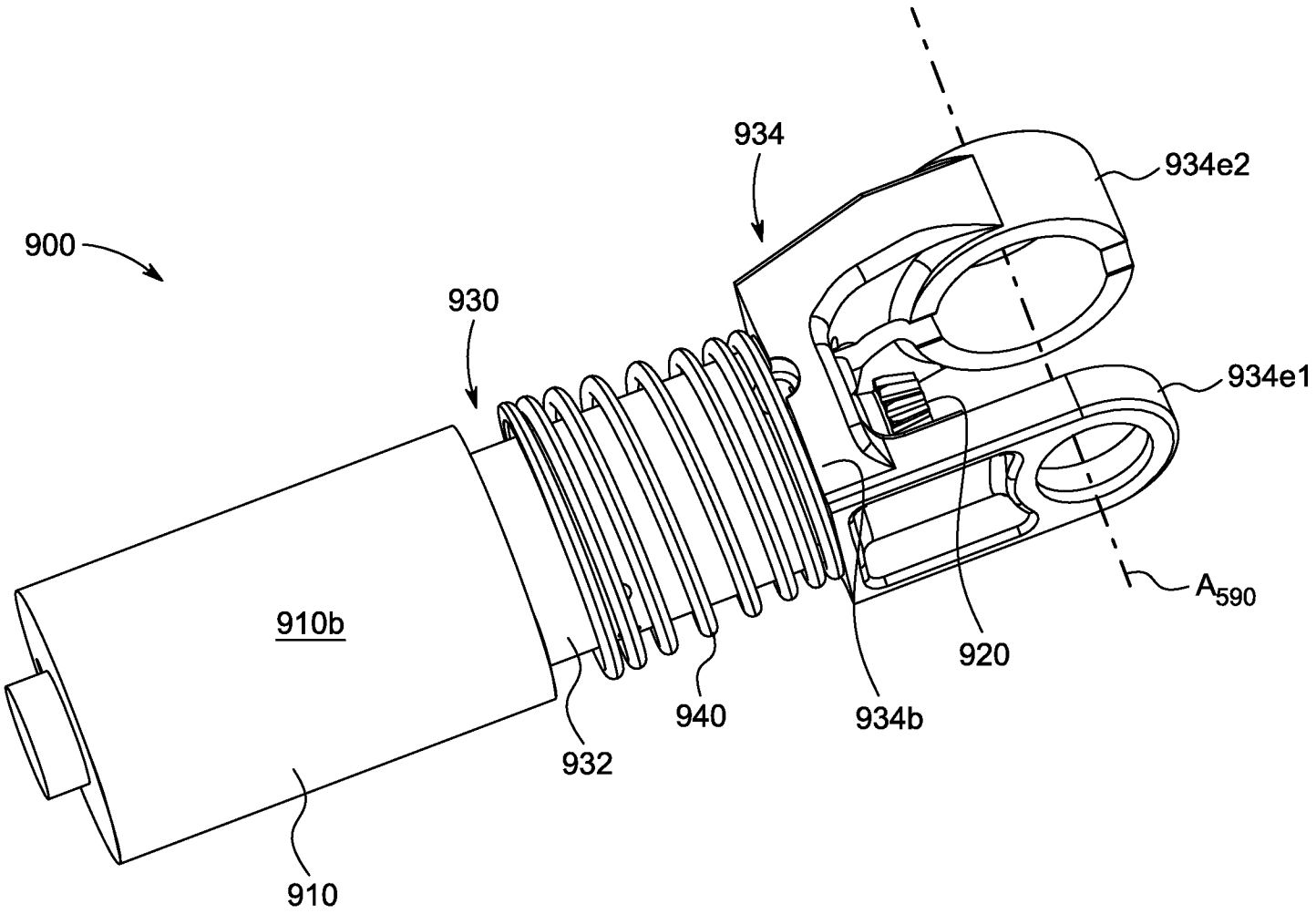
FIG. 7 is a perspective view of the motor assembly of the working assembly of FIGS. 3A and 3B.

The motor assembly 900, which is best shown in FIGS. 7 and 8, is operably connected to (via the transmission assembly 800) the tensioning assembly 500 and the sealing assembly 600 and is configured to drive those assemblies. The motor assembly 900 includes a motor 910, a drive gear 920, a motor mount 930, and a motor biasing element 940 (though other embodiments may not include the motor-biasing element 940).

As best shown in FIG. 7, the motor 910, which is an electric motor in this example embodiment but may be any suitable motor, includes a motor housing 910*b* and a rotatable output shaft 910*s* extending from the motor housing 910*b*. The drive gear 920, which is a bevel gear in this example embodiment but may be any other suitable gear, is fixedly mounted to the end of the output shaft 910*s* opposite the motor housing 910*b* such that the drive gear 920 and the output shaft 910*s* are fixed in rotation (i.e., rotate together) about a motor rotational axis $A_{910}$. Specifically, the motor 910 is configured to rotate the output shaft 910*s* and the drive gear 920 in opposing first and second drive directions D1 and D2 (FIG. 8) to carry out the tensioning and sealing cycles, respectively. The motor mount 930 includes a tubular body 932 and a head 934 at one end of the body 932. The head 934 includes a base 934*b* and spaced-apart first and second mounting ears 934*e*1 and 934*e*2 extending from the base 934*b*. The body 932 is fixedly mounted to the motor housing 910 (such as via suitable fasteners) such that the output shaft 910*s* extends through the body 932 and the drive gear 920 is between the mounting ears 934*e*1 and 934*e*2. The motor biasing element 940, which is a compression spring in this example embodiment but may be any suitable biasing element, circumscribes the body 932 of the motor mount 930 and is constrained at either end by the motor housing 910*b* and the base 934*b* of the head 934 of the motor mount 930.

Figure 9A:
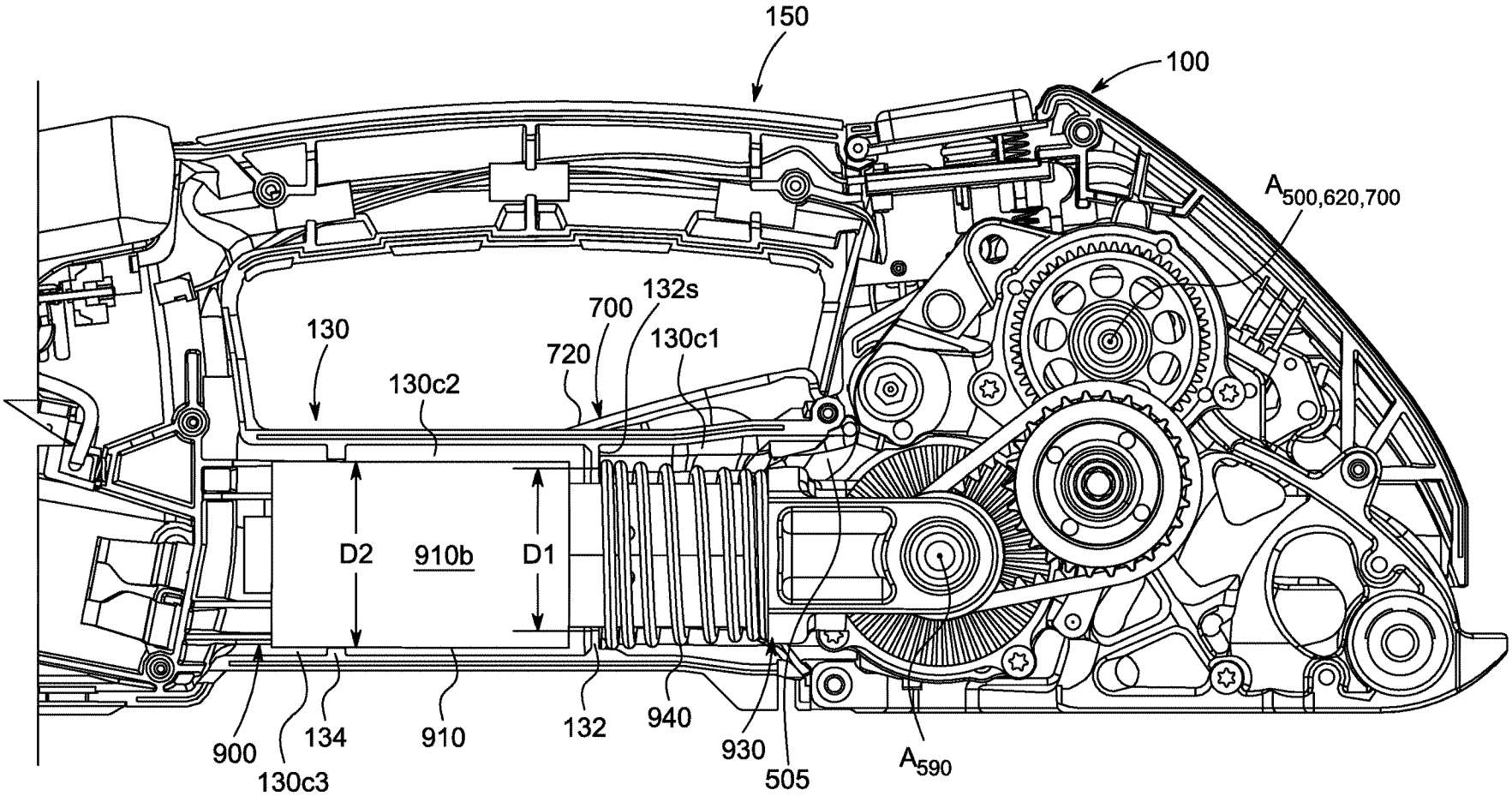
FIG. 9A is a partial side view of the strapping tool of FIGS. 1A and 1B with part of the front housing section, the motor housing section, the rear housing section, and the handle housing section removed and with the tensioning assembly in its strap-tensioning position and the motor assembly in its strap-tensioning configuration.
Figure 9B:
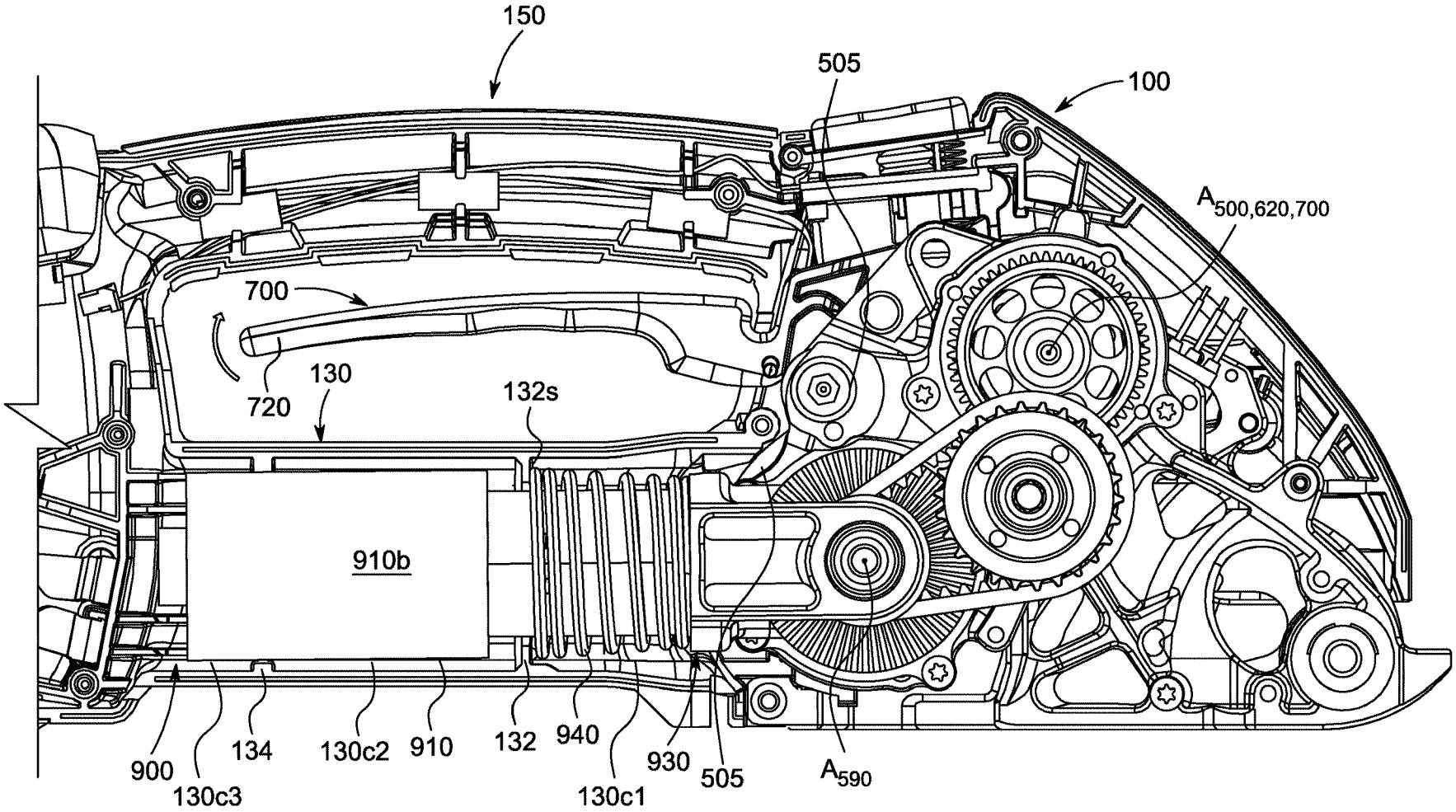
FIG. 9B is similar to FIG. 9A, but with the tensioning assembly between its strap-tensioning and strap-insertion positions and the motor assembly between its strap-tensioning and strap-insertion configurations.
Figure 9C:
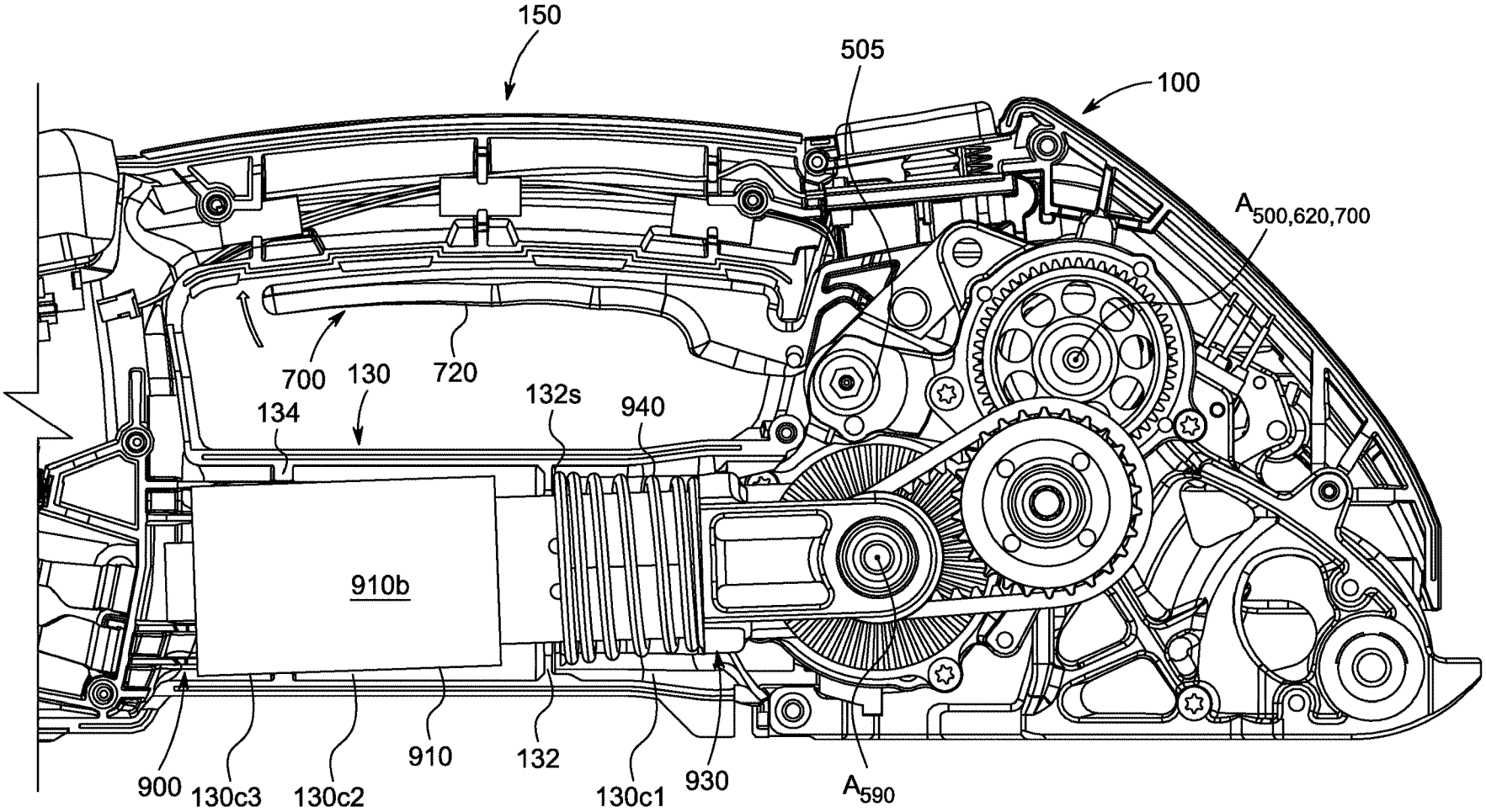
FIG. 9C is similar to FIG. 9A, but with the tensioning assembly in its strap-insertion position and the motor assembly in its strap-insertion configuration.

As shown in FIGS. 8-9C, the motor assembly 900 is pivotably mounted at one end to the tensioning assembly 500 and is housed within the motor housing section 130 of the housing 100 of the strapping tool 50 at the other end such that the motor 910 can move relative to the housing 100 and the tensioning assembly 500. The motor assembly 900 is mounted such that the drive gear 920 is meshed with—and therefore configured to drivingly engage—the first driven gear 812 of the first transmission-gear assembly 810 of the transmission assembly 800. As explained in detail below, the motor assembly 900 is mounted such that, as the tensioning assembly 500 pivots between the strap-tensioning and strap-insertion positions, the motor 910 can move (and in this example embodiment, both pivot and move longitudinally) relative to the housing 100 and the tensioning assembly 500 so the drive gear 920 maintains driving engagement with the first driven gear 812.

Specifically, the first mounting ear 934*e*1 of the head 934 of the motor housing 930 of the motor assembly 900 is mounted (via a suitable bearing, not labeled) to the driven shaft 522 of the tensioning-assembly gearing 510 of the tensioning assembly 500, and the second mounting ear 934*e*2 of the head 934 is mounted (via a suitable bearing, not labeled) to the support shaft 512*a* of the gearing support 512 of the tensioning-assembly gearing 510 such that the motor assembly 900 is pivotable relative to the tensioning assembly 500 about the tension-wheel rotational axis $A_{590}$.

The motor housing section 130 defines first, second, and third internal chambers 130*c*1, 130*c*2, and 130*c*3, respectively. The first internal chamber 130*c*1 is defined between the front housing section 110 and an inwardly extending constrainer 132 of the motor housing section 130. In this example embodiment, the constrainer 132 is annular and has an inner diameter D1. The second internal chamber 130*c*2 is defined between the constrainer 132 and an inwardly extending motor support 134. In this example embodiment, the motor support 134 is annular and has an inner diameter D2 that is greater than D1. The third internal chamber 130*c*3 is defined between the motor support 134 and the rear housing section 120.

The motor assembly 900 is housed within and extends through the internal chambers 130*c*1-130*c*3 of the motor housing section 130 of the housing 100. Specifically, the motor mount 930 is positioned within the first internal chamber 130*c*1 and extends through the constrainer 132 into the second internal chamber 130*c*2. The diameter D1 of the constrainer 132 is larger than the diameter of the body 132 of the motor mount 930, which (as described below) enables the motor mount 930 to move relative to the motor housing section 130. The diameter of the motor biasing element 940 is larger than D1 such that the motor biasing element 940 engages an annular engagement surface 132*s* of the constrainer 132 and is constrained between the constrainer 132 and the head 934 of the motor mount 930. The motor 910 is positioned within the second internal chamber 130*c*2 and extends through the motor support 134 into the third internal chamber 130*c*3. The diameter D2 of the motor support 134 is larger than the diameter of the motor housing 910*b* of the motor 910, which (as described below) enables the motor 910 to move relative to the motor housing section 130.

FIG. 9A shows the motor assembly 900 in a strap-tensioning configuration (including a position and an angular orientation) when the rocker lever 700 is in its home position and tensioning assembly 500 is in its strap-tensioning position. Here, the motor housing 910*b* of the motor 900 engages and is supported by the motor support 134 of the motor housing section 130. The motor biasing element 940 is compressed and biases the motor assembly 900 toward its strap-tensioning configuration and the tensioning assembly 500 to its strap-tensioning position.

FIG. 9B shows the position and orientation of the motor assembly 900 when the rocker lever 700 is between its home and actuated positions and the tensioning assembly 500 is between its strap-tensioning and strap-insertion positions. This pivoting of the tensioning assembly 500 caused the driven shaft 522 to move rearward toward the rear housing section 130 and upward toward the handle section 150. This movement of the driven shaft 522 caused the motor 910, the drive gear 920 connected to the motor 910, and the motor mount 930 to longitudinally move (relative to the motor housing section 130) rearward toward the rear housing section 120 and pivot upward above the horizontal about the tension-wheel rotational axis $A_{590}$. This movement also further compressed the motor biasing element 940.

FIG. 9C shows the motor assembly 900 in a strap-insertion configuration (including a position and an angular orientation) when the rocker lever 700 is in its actuated position and the tensioning assembly 500 is in its strap-insertion position. This further pivoting of the tensioning assembly 500 caused the driven shaft 522 to move further rearward toward the rear housing section 130 and further upward toward the handle section 150. This movement of the driven shaft 522 caused the motor 910, the drive gear 920 connected to the motor 910, and the motor mount 930 to longitudinally move (relative to the motor housing section 130) even further rearward toward the rear housing section 120 and pivot even further upward above the horizontal about the tension-wheel rotational axis $A_{590}$. This movement also further compressed the motor biasing element 940.

The ability of the motor assembly 900 to longitudinally move and pivot relative to the housing 100 as the tensioning assembly 500 pivots between its strap-tensioning and strap-insertion positions ensures the drive gear 920 of the motor assembly 900 maintains driving engagement with the first driven gear 812 of the transmission assembly 800. This enables the motor assembly 900, and in particularly the motor 910, to be housed within the motor housing section 130 rearward of the front housing section 120 and the remainder of the working assembly 200. Since the motor 910 is one of the heaviest components of the working assembly 200, this positioning of the motor results in the motor partially counter balancing the rest of the working assembly 200, which improves the ergonomics of the strapping tool 50 and makes it easier for operators to use over an extended period of time. Finally, the movability of the motor assembly 900 also enables the use of a simplified transmission design as compared to a fixed motor that would require a more complex transmission to prevent disengagement of transmission components.

The display assembly 1300, which is shown in FIGS. 1A-1C, includes a suitable display screen 1310 with a touch panel 1320. The display screen 1310 is configured to display information regarding the strapping tool 50 (at least in this embodiment), and the touch screen 1320 is configured to receive operator inputs such as a desired strap tension, desired weld cooling time, and the like as is known in the art. A display controller (not shown) may control the display screen 1310 and the touch panel 1320 and, in these embodiments, is communicatively connected to the controller 1600 to send signals to the controller 1600 and to receive signals from the controller 1600. Other embodiments of the strapping tool do not include a touch panel. Still other embodiments of the strapping tool do not include a display assembly. Certain embodiments of the strapping tool include a separate pushbutton panel instead of a touch panel beneath or integrated with the display screen.

The actuating assembly 1400, which is shown in FIGS. 1A-1C, is configured to receive operator input to start operation of the tensioning and sealing cycles. In this example embodiment, the actuating assembly 1400 includes first and second pushbutton actuators 1410 and 1420 that, depending on the operating mode of the strapping tool 50, initiate the tensioning and/or sealing cycles as described below. Other embodiments of the strapping tool 50 do not have an actuating assembly 1400 and instead incorporate its functionality into the display assembly 1300. For instance, in one of these embodiments two areas of the touch panel define virtual buttons that have the same functionality as mechanical pushbutton actuators.

The controller 1600, which is shown in FIG. 1C, includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping tool 50. The controller 1600 is communicatively and operably connected to the motor 910, the display assembly 1300, the actuating assembly 1400, and the sensor(s) 1700 and configured to receive signals from and to control those components. The controller 1600 may also be communicatively connectable (such as via Wi-Fi, Bluetooth, near-field communication, or other suitable wireless communications protocol) to an external device, such as a computing device, to send information to and receive information from that external device.

The controller 1600 is configured to operate the strapping tool in one of three operating modes: (1) a manual operating mode; (2) a semi-automatic operating mode; and (3) an automatic operating mode. In the manual operating mode, the controller 1600 operates the motor 910 to cause the tension wheel 590 to rotate responsive to the first pushbutton actuator 1410 being actuated and maintained in its actuated state. The controller 1600 operates the motor 910 to cause the sealing assembly 600 to carry out the sealing cycle responsive to the second pushbutton actuator 1420 being actuated. In the semi-automatic operating mode, the controller 1600 operates the motor 910 to cause the tension wheel 590 to rotate responsive to the first pushbutton actuator 1410 being actuated and maintained in its actuated state. Once the controller 1600 determines that the tension in the strap reaches the (preset) desired strap tension, the controller 1600 automatically operates the motor 910 to cause the sealing assembly 600 to carry out the sealing cycle (without requiring additional input from the operator). In the automatic operating mode, the controller 1600 operates the motor 910 to cause the tension wheel 590 to rotate responsive to the first pushbutton actuator 1410 being actuated. Once the controller 1600 determines that the tension in the strap reaches the (preset) desired strap tension, the controller 1600 automatically operates the motor 910 to cause the sealing assembly 600 to carry out the sealing cycle (without requiring additional input from the operator).

The sensors 1700 include any suitable sensors, such as microswitches, optical sensors, ultrasonic sensors, magnetic position sensors, and the like, configured to detect the position of certain components of the strapping tool 50 and to send appropriate signals to the controller 1600. The sensors 1700 may include, for instance: one or more tensioning-assembly-position sensors configured to detect when the tensioning assembly 500 is in its strap-tensioning position and/or its strap-insertion position; one or more camshaft-position sensors configured to detect the rotational position of the camshaft 620 and, specifically, whether the camshaft 620 is in a home rotational position; one or more rocker-lever-position sensors configured to detect when the rocker lever 700 is in its home position, its intermediate position, and/or its actuated position; and one or more actuating assembly sensors configured to detect actuation of the first and second pushbutton actuators 1410 and 1420.

The power supply is electrically connected to (via suitable wiring and other components) and configured to power several components of the strapping tool 50, including the motor 910, the display assembly 1300, the actuating assembly 1400, the controller 1600, and the sensor(s) 1700. The power supply is a rechargeable battery (such as a lithium-ion or nickel cadmium battery) in this example embodiment, though it may be any other suitable electric power supply in other embodiments. The power supply is sized, shaped, and otherwise configured to be received in the receptacle 122 defined by the rear housing section 120 of the housing 100. The strapping tool 50 includes one or more battery-securing devices (not shown) to releasably lock the power supply in place upon receipt in the receptacle. Actuation of a release device of the strapping tool 50 or the power supply unlocks the power supply from the housing 100 and enables an operator to remove the power supply from the receptacle 122.

Use of the strapping tool 50 to carry out a strapping cycle including: (1) a tensioning cycle in which the strapping tool 50 tensions strap around a load; and (2) a sealing cycle in which the strapping tool 50 attaches overlapping upper and lower portions of the strap to one another via a sealless strap joint is described below. Initially, the rocker lever 700 is in its home position, the tensioning assembly 500 is in its strap-tensioning position, and the die assembly 610 is in its home position. The strapping tool 50 is in the automatic mode for the purposes of this example.

Figure 3C:
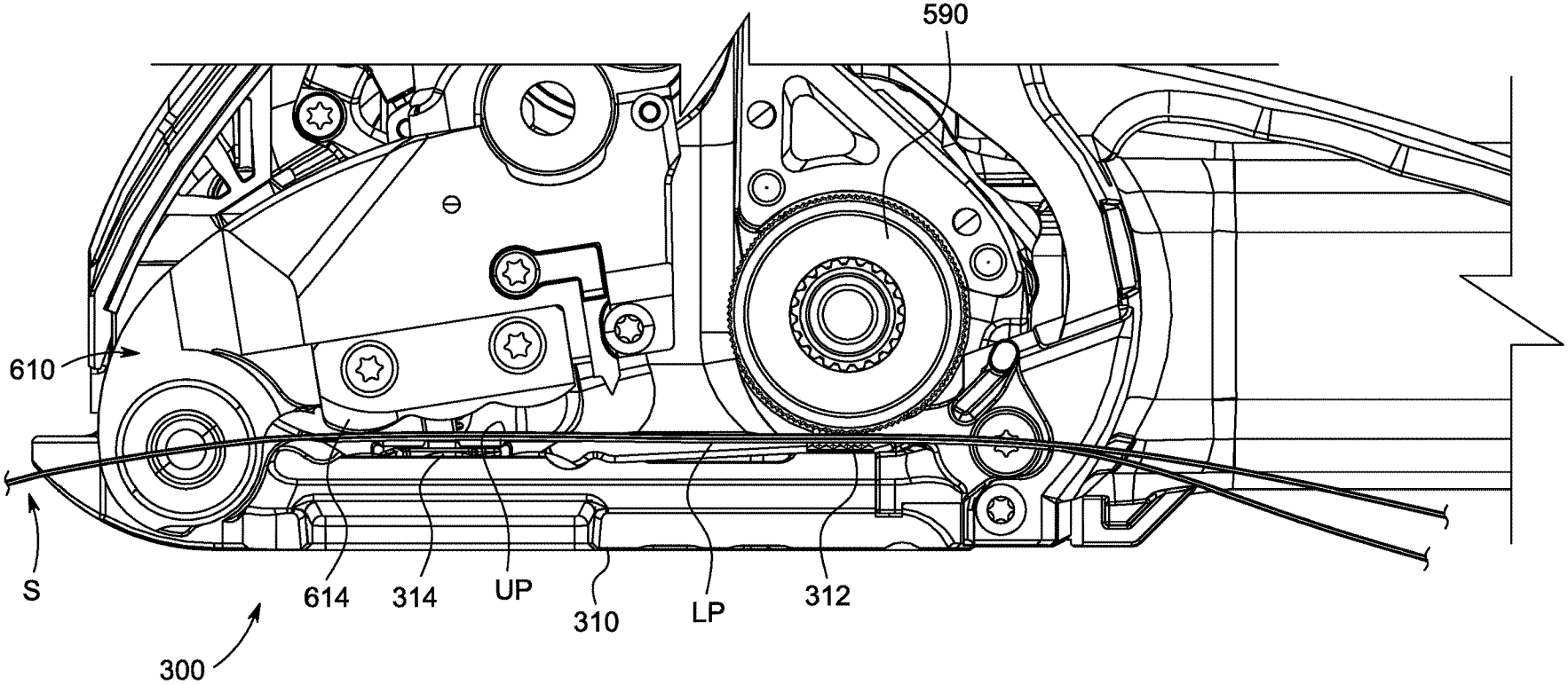
FIG. 3C is a partial side view of the working assembly of FIGS. 3A and 3B showing upper and lower strap portions extending between the die assembly of the sealing assembly and the support and between the tension wheel and the support.

The operator pulls the strap leading-end first from a strap supply (not shown), wraps the strap around the load, and positions the leading end of the strap S below another portion of the strap to form upper and lower portions of strap. The operator then pulls the rocker lever 700 from its home position to its actuated position to raise the tensioning assembly 500 from its strap-tensioning position to its strap-insertion position. While holding the rocker lever 700 in its actuated position, the operator introduces the overlapping upper and lower portions of the strap between the punch 314 (on the base 310 of the support 300) and the die 614 (of the die assembly 610 of the sealing assembly 600) and between the tensioning plate 312 (on the base 310 of the support 300) and the tension wheel 590 (of the tensioning assembly 500), as shown in FIG. 3C. The operator then releases the rocker lever 700, which causes various biasing elements to force the rocker lever 700 back to its home position and the tensioning assembly 500 back to its strap-tensioning position. This causes the tension wheel 590 to engage the top surface of the upper portion of strap and force the bottoms surface of the lower portion of strap against the tension plate 312.

The operator then actuates the first pushbutton actuator 1410 to initiate the strapping cycle. In response the controller 1600 starts the tensioning cycle by controlling the motor 910 to begin rotating the motor output shaft 910*s* in the first drive direction D1, which drives the first driven gear 812 of the transmission assembly 800 in the tensioning direction T. As explained in detail above, this causes the tension wheel 590 to begin rotating in the tensioning direction T and pull on the upper portion of the strap, thereby tensioning the strap around the load. Throughout the tensioning cycle, the controller 1600 monitors the current drawn by the motor 910. When this current reaches a preset value that is correlated with the (preset) desired strap tension for this strapping cycle, the controller 1600 stops the motor 910, thereby terminating the tensioning cycle.

The controller 1600 then automatically starts the sealing cycle by controlling the motor 910 to begin rotating the motor output shaft 910*s* in the second drive direction D2, which drives the first driven gear 812 in the release direction $T_{REV}$. As explained in detail above, this causes the camshaft 620 and to rotate in the sealing direction S, which pivots the die assembly 610 to its sealing position such that the dies 614 engage engage the upper portion of strap and force the lower portion of strap against the punch 314 of the base 310 of the support 300, eventually combining to cut keys in the overlapping upper and lower portions of strap. Meanwhile, the cutter 616 of the die assembly 610 cuts the strap from the strap supply. Once the cutter 616 cuts the strap from the strap supply, the upper portion of the strap slides relative to the lower portion of the strap, which causes the keys to interlock and form the sealless strap joint. Continued rotation of the camshaft 620 in the sealing direction S reverses this movement to return the die assembly 610 to its home position. After the sealing cycle is complete, the operator again pulls the rocker lever 700 to raise the tensioning assembly 500 and removes the strapping tool 50 from the tensioned strap loop.

Although the sealing assembly of the above-described example embodiment of the strapping tool comprises a punch and die configured to for a sealless connection in the strap, the sealing assembly may comprise other sealing mechanisms (such as notching jaw assembly, a crimping jaw assembly, a friction-welding assembly, an ultrasonic welding assembly, or a hot-knife assembly) in other embodiments configured to seal any suitable type of strap (such as metal, plastic, or paper strap).

The above-described example embodiment of the strapping tool includes a single motor configured to drive both the tensioning assembly and the sealing assembly. In other embodiments, the strapping tool includes separate motors configured to drive the respective tensioning and sealing assemblies. In these embodiments, either or both motors may be movable relative to the housing of the strapping tool to ensure their respective drive gears remain drivingly engaged to respective driven gears configured to drive the assemblies.

Other embodiments of the strapping tool may include fewer assemblies, components, and/or features than those included in the strapping tool 50 described above and shown in the Figures. In other words, while the strapping tool 50 includes all of the assemblies, components, and features described above, they are independent of one another and may be independently included in other strapping tools.

While the strapping device described above is a handheld strapping tool, the strapping device may be any other suitable strapping device in other embodiments, such as a standalone automatic or semi-automatic strapping machine.

The invention claimed is:

1. A strapping device comprising:

a housing;

a support;

a tensioning assembly comprising a rotatable tension wheel, wherein the tensioning assembly is at least partially housed within the housing and is mounted to and pivotable relative to the support between a strap-tensioning position and a strap-insertion position;

a driven gear operably connected to the tension wheel to drive the tension wheel; and a motor assembly comprising a motor and a drive gear driven by the motor, wherein the drive gear is drivingly engaged to the driven gear, wherein the motor assembly is at least partially housed within the housing such that, as the tensioning assembly moves from the strap-tensioning position to the strap-insertion position, at least part of the motor moves relative to the housing so the drive gear maintains driving engagement with the driven gear, wherein the movement of the at least part of the motor comprises both a longitudinal translation and a pivoting movement.

2. The strapping device of claim 1, wherein the motor assembly comprises a motor mount to which the motor is mounted, wherein the motor mount is pivotably mounted to the tensioning assembly.

3. The strapping device of claim 2, wherein the tensioning assembly comprises a driven shaft operably connected to the tension wheel, wherein the driven gear is operably connected to the driven shaft to drive the driven shaft, wherein the motor mount is pivotably mounted to the driven shaft.

4. The strapping device of claim 3, wherein the housing comprises a front housing section, a rear housing section, a motor housing section between the front and rear housing sections, and a handle section above the motor housing section and extending between the front and rear housing sections, wherein the tensioning assembly is at least partially housed within the front housing section, wherein the motor assembly is at least partially housed within the motor housing section, wherein the movement of the tensioning assembly from the strap-tensioning position to the strap-insertion position causes the driven shaft to move toward the rear housing section and toward the handle section, thereby causing the at least part of the motor to longitudinally translate within the motor housing section toward the rear housing section and to pivot.

5. The strapping device of claim 3, further comprising a freewheel mounted to and circumscribing the driven shaft, wherein the driven gear is mounted to and circumscribes the freewheel, wherein the freewheel is configured to:

transmit rotational movement of the driven gear in a tensioning rotational direction to the driven shaft such that the driven shaft rotates with the driven gear in the tensioning rotational direction; and not transmit rotational movement of the driven gear in a rotational direction opposite the tensioning rotational direction to the driven shaft such that the driven gear rotates relative to and around the driven shaft.

6. The strapping device of claim 5, wherein the tensioning assembly further comprises tensioning-assembly gearing operably connecting the driven gear to the tension wheel, wherein the tensioning-assembly gearing comprises the driven shaft.

7. The strapping device of claim 6, wherein the tension wheel and the driven shaft are rotatable about a first rotational axis, wherein the drive gear is rotatable about a second rotational axis transverse to the first rotational axis.

8. The strapping device of claim 1, wherein the motor assembly is in a strap-tensioning configuration when the tensioning assembly is in the strap-tensioning position and in a strap-insertion configuration when the tensioning assembly is in the strap-insertion position.

9. The strapping device of claim 8, further comprising a motor assembly biasing element biasing the motor assembly to the strap-tensioning configuration.

10. The strapping device of claim 9, wherein the motor assembly comprises a motor mount comprising a body to which the motor is mounted and a head pivotably mounted to the tensioning assembly.

11. The strapping device of claim 10, wherein the motor assembly comprises the motor assembly biasing element.

12. The strapping device of claim 11, wherein the housing comprises a front housing section, a rear housing section, a motor housing section between the front and rear housing sections, and a handle section above the motor housing section and extending between the front and rear housing sections, wherein the tensioning assembly is at least partially housed within the front housing section, wherein the motor assembly is at least partially housed within the motor housing section, wherein the motor housing section comprises a constrainer, wherein the motor assembly is positioned such that the motor assembly biasing element is constrained between the constrainer and the head of the motor mount.

13. The strapping device of claim 8, wherein at least one of a position and an orientation of the at least part of the motor relative to the housing differs between the strap-tensioning configuration and the strap-insertion configuration.

14. The strapping device of claim 1, wherein the at least part of the motor comprises an output shaft fixed in rotation with the drive gear.

15. A strapping device comprising:

a housing;

a support;

a tensioning assembly comprising a rotatable tension wheel and a driven shaft operably connected to the tension wheel, wherein the tensioning assembly is at least partially housed within the housing and is mounted to and pivotable relative to the support between a strap-tensioning position and a strap-insertion position;

a driven gear operably connected to the tension wheel via the driven shaft to drive the tension wheel, wherein the motor mount is pivotably mounted to the driven shaft; and a motor assembly comprising a motor, a drive gear driven by the motor and drivingly engaged to the driven gear, and a motor mount to which the motor is mounted, wherein the motor mount is pivotably mounted to the tensioning assembly, wherein the motor assembly is at least partially housed within the housing such that, as the tensioning assembly moves from the strap-tensioning position to the strap-insertion position, at least part of the motor moves relative to the housing so the drive gear maintains driving engagement with the driven gear.

16. The strapping device of claim 15, wherein the housing comprises a front housing section, a rear housing section, a motor housing section between the front and rear housing sections, and a handle section above the motor housing section and extending between the front and rear housing sections, wherein the tensioning assembly is at least partially housed within the front housing section, wherein the motor assembly is at least partially housed within the motor housing section, wherein the movement of the tensioning assembly from the strap-tensioning position to the strap-insertion position causes the driven shaft to move toward the rear housing section and toward the handle section, thereby causing the at least part of the motor to longitudinally translate within the motor housing section toward the rear housing section and to pivot.

17. The strapping device of claim 15, further comprising a freewheel mounted to and circumscribing the driven shaft, wherein the driven gear is mounted to and circumscribes the freewheel, wherein the freewheel is configured to:

transmit rotational movement of the driven gear in a tensioning rotational direction to the driven shaft such that the driven shaft rotates with the driven gear in the tensioning rotational direction; and not transmit rotational movement of the driven gear in a rotational direction opposite the tensioning rotational direction to the driven shaft such that the driven gear rotates relative to and around the driven shaft.

18. The strapping device of claim 17, wherein the tensioning assembly further comprises tensioning-assembly gearing operably connecting the driven gear to the tension wheel, wherein the tensioning-assembly gearing comprises the driven shaft.

19. The strapping device of claim 18, wherein the tension wheel and the driven shaft are rotatable about a first rotational axis, wherein the drive gear is rotatable about a second rotational axis transverse to the first rotational axis.

20. A strapping device comprising:

a housing comprising a front housing section, a rear housing section, a motor housing section comprising a constrainer and positioned between the front and rear housing sections, and a handle section above the motor housing section and extending between the front and rear housing sections;

a support;

a tensioning assembly at least partially housed within the front housing section and comprising a rotatable tension wheel, wherein the tensioning assembly is at least partially housed within the housing and is mounted to and pivotable relative to the support between a strap-tensioning position and a strap-insertion position;

a driven gear operably connected to the tension wheel to drive the tension wheel; and a motor assembly at least partially housed within the motor housing section, wherein the motor assembly is in a strap-tensioning configuration when the tensioning assembly is in the strap-tensioning position and in a strap-insertion configuration when the tensioning assembly is in the strap-insertion position, the motor assembly comprising:

a motor;

a drive gear driven by the motor and drivingly engaged to the driven gear;

a motor mount comprising a body to which the motor is mounted and a head pivotably mounted to the tensioning assembly; and a motor assembly biasing element constrained between the constrainer and the head of the motor mount and biasing the motor assembly to the strap-tensioning configuration, wherein the motor assembly is at least partially housed within the housing such that, as the tensioning assembly moves from the strap-tensioning position to the strap-insertion position, at least part of the motor moves relative to the housing so the drive gear maintains driving engagement with the driven gear.

* * * * *